United States Patent [19]

Yamashita et al.

[11] Patent Number: 4,511,648

[45] Date of Patent: Apr. 16, 1985

[54] LIGHT-SENSITIVE SILVER HALIDE COLOR PHOTOGRAPHIC MATERIAL

[75] Inventors: Kiyoshi Yamashita; Toshifumi Iijima, both of Hino, Japan

[73] Assignee: Konishiroku Photo Industry Co., Ltd., Tokyo, Japan

[21] Appl. No.: 474,663

[22] PCT Filed: Jul. 10, 1982

[86] PCT No.: PCT/JP82/00260

§ 371 Date: Feb. 24, 1983

§ 102(e) Date: Feb. 24, 1983

[87] PCT Pub. No.: WO83/00234

PCT Pub. Date: Jan. 20, 1983

[30] Foreign Application Priority Data

| | | | |
|---|---|---|---|
| Jul. 10, 1981 | [JP] | Japan | 56-106908 |
| Dec. 11, 1981 | [JP] | Japan | 56-200477 |
| Dec. 12, 1981 | [JP] | Japan | 56-200611 |
| Dec. 13, 1981 | [JP] | Japan | 56-200552 |

[51] Int. Cl.[3] ..... G03C 1/46; G03C 1/08

[52] U.S. Cl. ..... 430/503; 430/506; 430/509

[58] Field of Search ..... 430/503, 506, 509

[56] References Cited

U.S. PATENT DOCUMENTS

| | | | |
|---|---|---|---|
| 4,129,446 | 12/1978 | Lohmann et al. | 430/506 |
| 4,186,011 | 1/1980 | Lohmann et al. | 430/506 |
| 4,370,410 | 1/1983 | Iijima et al. | 430/506 |
| 4,409,321 | 10/1983 | Onodera et al. | 430/506 |
| 4,414,308 | 11/1983 | Hamada | 430/506 |

FOREIGN PATENT DOCUMENTS

| | | | |
|---|---|---|---|
| 1221079 | 2/1971 | United Kingdom | 430/506 |

OTHER PUBLICATIONS

Derwent Abst. 59529 to JP 156975, (6-29-1981).

*Primary Examiner*—Mary F. Downey

*Attorney, Agent, or Firm*—Frishauf, Holtz, Goodman & Woodward

[57] ABSTRACT

This invention presents a light-sensitive silver halide color photographic material having at least two silver halide emulsion layers having sensitivities in different spectral regions on the same side of a support, at least one layer of the layers comprising at least two silver halide emulsion layers with different sensitivities, in which each of the at least two silver halide emulsion layers with different sensitivities contains at least one kind of substantially monodispersed silver halide crystals and at least one silver halide emulsion layer of the layers comprises substantially silver iodobromide containing 4 mole % or more of silver iodide, and further the iodine content in the emulsion layer having the highest sensitivity is higher than that of the emulsion layer having a sensitivity second to the highest. The light-sensitive silver halide color photographic material of this invention has a wide latitude of exposure and can be developed suitably without receiving influence from the processing time of color development.

21 Claims, No Drawings

LIGHT-SENSITIVE SILVER HALIDE COLOR PHOTOGRAPHIC MATERIAL

TECHNICAL FIELD

This invention relates to a light-sensitive silver halide color photographic material, more particularly, to a light-sensitive silver halide color photographic material improved in latitude of exposure.

BACKGROUND ART

Light-sensitive color photographic materials for photographing in general are required to obtain preferable images in a broad exposure range. That is, it is desired to have light-sensitive color photographic materials having a broad latitude of exposure. In the prior art, there have been known such methods as mentioned below as the techniques for such broadening of latitude.

One method comprises broadening the crystal size distribution of silver halide crystals by such a method as mixing crystals with different crystal sizes, namely large crystals and small crystals, etc. corresponding to the desired latitude. It is also known to attempt broadening of latitude by separating silver halide emulsion layers having respective color sensitivities into a high sensitivity layer and a low sensitivity layer, as disclosed in Japanese Provisional Patent Publication No. 42355/1974, U.S. Pat. No. 3,843,469, etc. Further, there is also known the method in which broadening of latitude is attempted by reducing the silver halide content in a light-sensitive material.

However, a number of problems are known to be involved in any of the light-sensitive silver halide materials using the above methods, such as worsening of graininess and development stability, etc.

Also, in case of a light-sensitive color photographic material having a negative type silver halide emulsion layer of softer gradation, there is the method to attempt broadening of latitude by use of a multiequivalent coupler to reduce utilization efficiency of silver halide, as disclosed in Japanese Provisional Patent Publication No. 135841/1981. However, this method requires an increased amount of silver halide, thus involving a great problem from the standpoint of silver saving.

Further, it is also known in the art that latitude can be broadened by applying a compound capable of releasing a development inhibitor at the time of developing such as an inhibitor releasing type developer, an inhibitor releasing type coupler (DIR coupler) or an inhibitor releasing type compound (DIR substance) to a light-sensitive material. However, these compounds not only broaden latitude but also may sometimes cause sensitivity reduction during storage, whereby the extent of broadening of latitude is naturally limited. Also, while it is possible to control the latitude by increasing the iodine content in a silver halide emulsion, increase of the iodine content in a silver halide results disadvantageously in lowering of emulsion sensitivity.

In the prior art, a polydispersed emulsion is employed in a silver halide emulsion as the emulsion. This is because use of a monodispersed silver halide emulsion, while it enables uniform chemical ripening of respective crystals on account of a narrow crystal size distribution of silver halide and is also advantageous in aspect of crystal size-sensitivity, involves the drawback that the gradation becomes hard and the latitude of exposure is narrowed. Accordingly, although a polydispersed silver halide emulsion is employed in any of the methods as described above, none of these methods are sufficient in imparting broad latitude and providing good sensitivity and development stability.

An object of this invention is to provide a light-sensitive material improved in reducing the drawbacks as described above possessed by the light-sensitive color photographic materials of the prior art, particularly a light-sensitive silver halide color photographic material which, while maintaining a high sensitivity characteristic of a monodispersed emulsion, has a broad latitude of exposure and is also excellent in gradation characteristic.

Another object of this invention is to provide a light-sensitive silver halide color photographic material having a stable performance during developing treatment in addition to the above performances.

DISCLOSURE OF THE INVENTION

The light-sensitive silver halide color photographic material of this invention is a light-sensitive silver halide color photographic material having at least two silver halide emulsion layers having sensitivities in different spectral regions on the same side of a support, at least one layer of said silver halide emulsion layers having sensitivities in different spectral regions comprising at least two silver halide emulsion layers with different sensitivities, being characterized in that each of said at least two silver halide emulsion layers with different sensitivities contains at least one kind of substantially monodispersed silver halide crystals and at least one silver halide emulsion layer of said layers comprises substantially silver iodobromide containing 4 mole % or more of silver iodide, and further that the iodine content in the emulsion layer having the highest sensitivity is higher than that of the emulsion layer having a sensitivity second to the highest.

The effect of this invention to enable enlarging of latitude of exposure by use of a monodispersed emulsion greater than that by use of a polydispersed emulsion of the prior art is surprising. That is, it has been considered that broadening of latitude with soft gradiation is difficult, because chemical ripening is effected uniformly for respective crystals with uniform sizes in a monodispersed emulsion.

The present inventors have made extensive studies and consequently found that the above inconvenience can be cancelled under the condition where the constitutions of the higher sensitivity layer and the lower sensitivity layer satisfy the requirements of this invention, whereby a great improved effect as unexpected from the state of the prior art could be obtained.

In the following, this invention is to be described in further detail.

The light-sensitive silver halide color photographic material of this invention is based on a constitution which is formed of at least two silver halide emulsion layers having sensitivities in different spectral regions on the same side of a support, namely having a plurality of silver halide emulsions having light-sensitivities in different spectral regions, and at least one layer of said silver halide emulsion layers being formed of a plurality of emulsion layers having light-sensitivities in the same spectral region with different sensitivities.

In the above light-sensitive silver halide color photographic material, the light-sensitive material of this invention is characterized in the first place in that each of the silver halide emulsion layers having light-sensitivities in the same spectral region with different sensitivities contains at least one kind of substantially monodispersed silver halide crystals. The term "monodispersed" herein used means that the value obtained by dividing the standard deviation S defined by the following formula by the average crystal size $\bar{r}$ is 0.15 or less.

$$S = \sqrt{\frac{\Sigma(\bar{r} - r_i)^2 n_i}{\Sigma n_i}}$$

$$\frac{S}{\bar{r}} \leqq 0.15$$

The average crystal size $\bar{r}$ herein mentioned refers to a average value of the diameters of silver halide crystals when they are spherical, or of the diameters of spherical images calculated to have the same areas as the projected images of silver halide crystals when they are shaped in cubes or other forms than spherical forms. When individual crystal size is represented by $r_i$ and its number by $n_i$, the average crystal size $\bar{r}$ is defined by the following formula:

$$\bar{r} = \frac{\Sigma n_i r_i}{\Sigma n_i}$$

In this invention, of the aforementioned plural emulsion layers having light-sensitivities in the same spectral region with different sensitivities, the emulsion layer having the lowest sensitivity, which contains at least one kind of substantially monodispersed silver halide crystals therein, may preferably contain two or more kinds of substantially monodispersed silver halide crystals with different average crystal sizes. When two or more kinds of these monodispersed silver halide crystals are used, it is preferred that the sensitivity difference between the monodispersed silver halide crystals with respective crystal sizes as represented by the difference in logarithmic value of doses of exposure (Δ log E) necessary for obtaining a dye density with a fog density +0.1 may be set within the range from 0.2 to 1.5, more preferably from 0.3 to 0.8. Also, when two or more kinds of monodispersed silver halide crystals are to be used, the crystal size difference between the monodispersed silver halide crystals with respective crystal sizes may preferably be 0.1 to 1.2μ, more preferably 0.2 to 0.8μ. Further, the respective average crystal sizes of the monodispersed silver halide crystals contained in the plural emulsion layers with different sensitivities may preferably different. For example, the silver halide crystals contained in the emulsion layer with higher sensitivity may preferably have an average crystal size of 0.4 to 1.5μ, while those contained in the emulsion layer with lower sensitivity a average crystal size of 0.1 to 0.8μ.

The silver halide crystals to be used in this invention may be shaped in so called twin crystals, having irregular shapes such as plates, etc., or alternatively they may have regular shapes such as cubic, octahedral or tetradecahedral spherical types, etc. Further, said silver halide crystals may have a structure of the so called core-shell type, having a core portion and a shell portion. In this case, the core portion and the shell portion have different photographic characteristics and/or silver halide compositions. In the shell portion, no silver iodide may be contained.

In the next place, the light-sensitive material of this invention is characterized in that, in the plural emulsion layers having light-sensitivities in the same spectral region with different sensitivities, the silver halide emulsion contained in at least one emulsion layers comprises substantially silver iodobromide containing 4 mole % or more of silver iodide. When the content of silver iodide is less than 4 mole %, developing characteristic becomes markedly rapid particularly in case of silver iodobromide with small crystal sizes, whereby it is generally difficult to enlarge latitude of exposure. The silver halide crystals in other emulsion layers may comprise substantially silver iodobromide. In this invention, "the silver halide crystals comprising substantially silver iodobromide" means silver iodobromide containing 0.5 to 15 mole % of silver iodide, but said silver iodobromide may also contain 10 mole % or less of silver chloride. Also, the emulsion layer containing silver halide crystals comprising said silver iodobromide according to this invention may contain at least one silver halide selected from the group consisting of silver chloride, silver bromide and silver chlorobromide within a range which does not impair the effect of this invention.

Further, the light-sensitive material of this invention is characterized in that the iodine content in the emulsion layer having the highest sensitivity in the aforementioned plural emulsion layers having the light-sensitivities in the same spectral region with different sensitivities is higher than the emulsion layer with a sensitivity second to the highest. By setting the emulsion layers in this manner, the latitude of exposure can be enlarged and developing process stability increased.

It is preferred that the difference in iodine content in the silver halide between the emulsion layer having the highest sensitivity and the emulsion layer having the second sensitivity may be within the range from 0.1 to 10 mole %, more preferably from 0.1 to 4 mole %. It is also preferred that the iodine content in the silver halide crystals in the emulsion layer with the lowest sensitivity may be at least 4 mole %, more preferably 5 mole % or more. When the iodine content is less than 4 mole %, developing characteristic becomes markedly rapid, particularly in case of silver iodobromide with small crystal sizes, whereby it is generally difficult to enlarge latitude of exposure. Also, in the above plural emulsion layers with different sensitivities, it is preferred that the sensitivity difference between the emulsion layers as represented by the difference in logarithmic value of doses of exposure (Δ log E) necessary for obtaining a dye density with a fog density +0.1 may be set within the range from 0.2 to 1.5, more preferably from 0.3 to 0.8. Within this range, the light-sensitive material has an excellent performance that the linearity of its gradation can be retained. Further, the above plural emulsion layers with different sensitivities of this invention may preferably be formed so that layers with higher sensitivities may be located at higher positions as seen from the support.

Generally speaking, light-sensitive silver halide color photographic materials are constituted of a plurality of light-sensitive silver halide emulsion layers with different color sensitivities uniformly coated to dry thicknesses of several microns on a support such as cellulose triacetate, polyethyleneterephthalate or the like.

In the light-sensitive silver halide color photographic material of this invention, at least one layer in at least two layers of silver halide emulsion layers with different spectral sensitivities existing on the same side of a support satisfy the above condition. The silver halide emulsion layers having such spectral sensitivities, namely light-sensitivities in certain spectral regions, are emulsion layers of at least two kinds of regions selected from the group consisting of the red-sensitive region, the green-sensitive region and the blue-sensitive region, and these are formed on a support. In applying such light-sensitive silver halide color photographic materials for a multi-layer light-sensitive color photographic material having, for example, a blue-sensitive emulsion layer, a green-sensitive emulsion layer and a red-sensitive emulsion layer, one layer or two or more layers may satisfy the above condition. It is preferred, however, that at least the green-sensitive emulsion layer may satisfy the above condition, since human eyes have the highest sensitivity to green light among visible lights. Among these, for providing above all broad latitude of exposure, all of the blue-sensitive emulsion layer, the green-sensitive emulsion layer and the red-sensitive emulsion layer may satisfy the above condition.

When the light-sensitive silver halide color photographic material of this invention is used for a negative type light sensitive silver halide color photographic material, the constitution of this invention may be practiced by use of negative type silver halide emulsions. The negative type silver halide emulsion herein mentioned refers to a surface latent image type emulsion having sensitive nuclei primarily on the surfaces of silver halide crystals, which can form blackened silver images by subjecting said emulsion to light exposure and performing thereafter development with the use of a surface developer, said blackened densities being inversely proportional to the lightness of an object to be photographed.

A light-sensitive color photographic material employing the above negative type silver halide emulsion has at least two kinds of emulsion layers each containing negative type silver halide crystals having a plurality of layer having different color sensitivities. A light-sensitive color photographic material for natural color will generally have three kinds of emulsion layers with different color sensitivities, and these layers are arranged in the order of, for example, red-sensitive emulsion layer, green-sensitive emulsion layer and blue-sensitive emulsion layer, from a support toward the outermost layer.

The silver halide crystals used in the light-sensitive color photographic material in accordance with the present invention may be prepared by the acid process, neutral process or ammonia process. It is also possible to prepare seed crystals by the acid process, and grow them up to the predetermined size by the ammonia process which gives a high growth rate. When growing the silver halide crystals, it is desirable that the pH, pAg or the like in the reactor are controlled, and silver ions and halide ions are both poured sequentially and simultaneously and mixed in quantities matching the growth rate of silver halide grains, that is so called double jet method as described for example in Japanese Provisional Patent Publication No. 48521/1979.

The silver halides may be chemically sensitized with active gelatin; a sulfur sensitizer e.g. allylthiocarbamide, thiourea or cystine; a selenium sensitizer; a reduction sensitizer e.g. tin (II) salt, thiourea dioxide and polyamine; a noble metal sensitizer, e.g. gold sensitizer such as potassium aurithiocyanate, potassium chloroaurate, water-soluble gold salts or a water-soluble salt of ruthenium, platinum, rhodium or iridium, e.g. potassium chloroplatinate (some of these serve as sensitizers or fog restrainers depending on the amount used). These sensitizers may be used alone or in combination (e.g. a combination of the gold sensitizer with the sulfur sensitizer, or a combination of the gold sensitizer with selenium sensitizer).

Further, the silver halides may be optically sensitized (in which so-called super-sensitization may be obtained) to a desired wavelength region for example by using an optical sensitizer e.g. a cyanine dye such as zeromethine dye, monomethine dye, dimethine dye or trimethine dye, or a merocyanine dye singly or in combination of two or more.

As for the coupler used in the light-sensitive color photographic material in accordance with the present invention, i.e. the compound forming a dye by the reaction with an oxidized product of the color developing agent, it is sufficient only if it exists substantially at the time of color development. The coupler may be contained in the color developing solution or in the light-sensitive color photographic material. When the coupler is non-diffusion type, it is preferably contained in the light-sensitive color photographic material.

Generally, the coupler is contained in the light-sensitive layer of the light-sensitive color photographic material.

The coupler can be incorporated in the light-sensitive color photographic material in various ways in accordance with the present invention. When the coupler is soluble in an alkali, it may be added in the form of an alkaline solution. When it is soluble in an oil, it is preferably dissolved in a high boiling solvent optionally in combination with a low boiling solvent and finely dispersed in the silver halide emulsion according to the procedures described in U.S. Pat. Nos. 2,322,027, 2,801,170, 2,801,171, 2,272,191 and 2,304,940. In this case, it is also possible to additionally add a hydroquinone derivative, an ultra violet ray absorber, a discoloration preventing agent or the like as required. It is also possible to use a mixture of two or more couplers. In the incorporation of the coupler into the light-sensitive material, one or more couplers may be dissolved optionally together with another coupler, a hydroquinone derivative, a discoloration preventing agent, an ultra violet ray absorber or the like as required in a high boiling solvent such as an organic acid amide, a carbamate, an ester, a ketone, a urea derivative or the like, particularly di-n-butyl phthalate, tri-cresyl phosphate, triphenyl phosphate, di-isooctyl azelate, di-n-butyl sebacate, tri-n-hexyl phosphate, N,N-diethyl-caprylamide butyl, N,N-diethyllaurylamide, n-pentadecyl phenyl ether, dioctyl phthalate, n-nonyl phenol, 3-pentadecylphenyl ethyl ether, 2,5-di-sec.-amylphenyl butyl ether, monophenyl-di-o-chlorophenyl phosphate, or a fluoroparaffin, or if necessary in a low boiling solvent such as methyl acetate, ethyl acetate, propyl acetate, butyl acetate, butyl propionate, cyclohexanol, diethylene glycol monoacetate, nitromethane, carbon tetrachloride, chloroform, cyclohexane, tetrahydrofuran, methyl alcohol, acetonitrile, dimethylformamide, dioxane or ethyl methyl ketone. The solution thus formed may be mixed with an aqueous solution containing a hydrophilic binder such as gelatin and an anionic surface active agent such as alkylbenzenesulfonate or alkylnaphthalenesulfonate and/or a nonionic surface active agent such as sorbitan sesquioleate or sorbitan monolaurate. The mixture thus obtained may then be emulsified and dispersed in a high-speed rotating mixer, colloid mill, supersonic dispersing unit or the like, and added to a constituent of the light-sensitive color photographic material in accordance with the present invention, preferably the silver halide emulsion.

Further, the coupler may be dispersed in the photosensitive material by a latex dispersing method.

The latex dispersing method and its effect are described for example in Japanese Provisional Patent Publication Nos. 74538/1974, 59943/1976 and 32552/1979, and "Research Disclosure", August 1976, No. 14850, pages 77–79.

Examples of suitable lateces are homopolymers, copolymers and terpolymers of monomers such as styrene, ethyl acrylate, n-butyl acrylate, n-butyl methacrylate, 2-acetoacetoxyethyl methacrylate, 2-(methacryloyloxy)ethyltrimethylammonium sulfate, sodium 3-(methacryloyloxy)propane-1-sulfonate, N-isopropylacrylamide, N-[2-(2-methyl-4-oxopentyl)]acrylamide, and 2-acrylamido-2-methylpropane sulfonate.

The amount of the coupler used is not critical. However, when it is added to the light-sensitive color photographic material, it is preferably used in an amount between 10 g and 100 g per one mole of silver halide. When it is added to the color developing solution, it is used preferably in an amount between about 0.1 g and 3 g per liter of the color developing solution.

For the purpose of preventing the dye from discolorating due to active rays having a short wavelength, it is advantageous to use ultraviolet ray absorbers such as thiazolidone, benzotriazole, acrylonitrile and benzophenone compounds together with the coupler in the light-sensitive color photographic material in accordance with the present invention. It is particularly advantageous to use Tinuvin P's, 320, 326, 327 and 328 (available from Ciba-Geigy AG) alone or in combination.

The hydroquinone derivatives used together with the coupler in the light-sensitive color photographic material in accordance with the present invention also include their precursors. The precursors as used herein mean the compounds releasing hydroquinone derivatives by hydrolysis.

Examples of the discoloration preventing agents used together with the coupler in the present invention preferably include coumarone, coumaran and spirochroman compounds and the like.

The coupler used in the light-sensitive color photographic material in accordance with the present invention may be of either two or four equivalent type of an optional combination thereof.

Further, the coupler may be a low molecular coupler or the so-called polymeric coupler.

The coupler used in the light-sensitive color photographic material in accordance with the present invention may be any of the known photographic couplers, preferably α-acylacetamide yellow coupler (α-benzoylacetanilide yellow coupler, α-pivaloylacetanilide yellow coupler or the like), 5-pyrazolone magenta coupler, pyrazolinobenzoimidazole magenta coupler, phenol cyan coupler or naphthol cyan coupler.

Typical examples of the α-acylacetamide yellow couplers used in the present invention are:

[Y - 1]

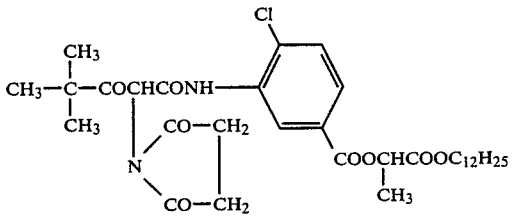

[Y - 2]

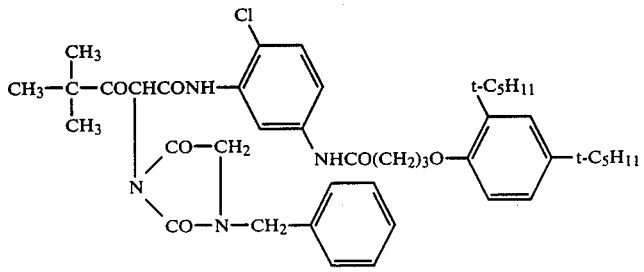

[Y - 3]

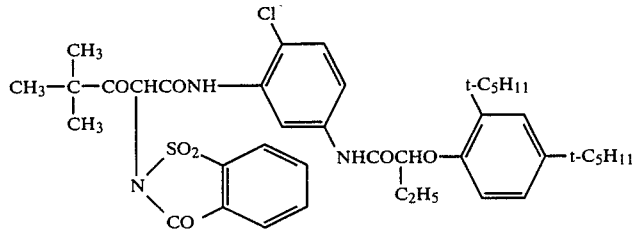

-continued
[Y - 4]
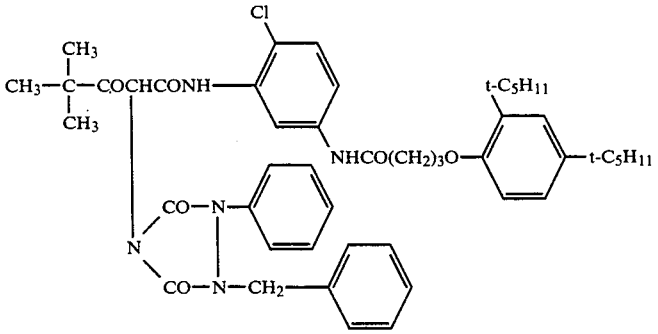
[Y - 5]
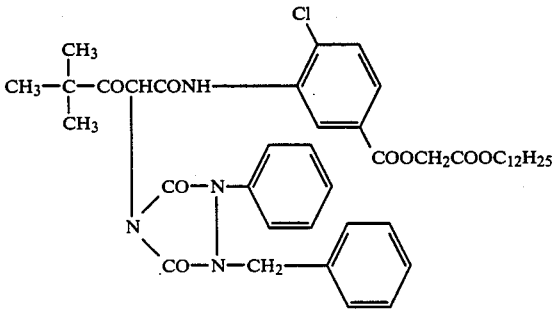
[Y - 6]
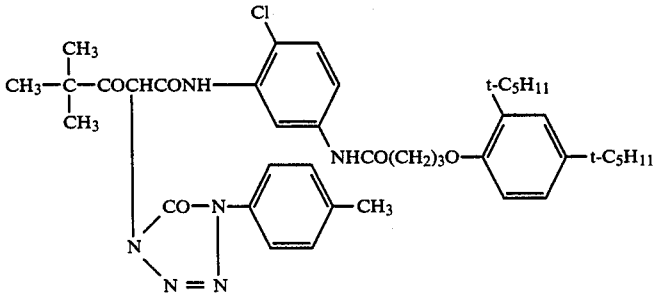
[Y - 7]
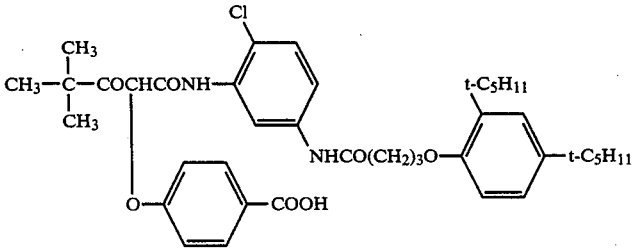
[Y - 8]
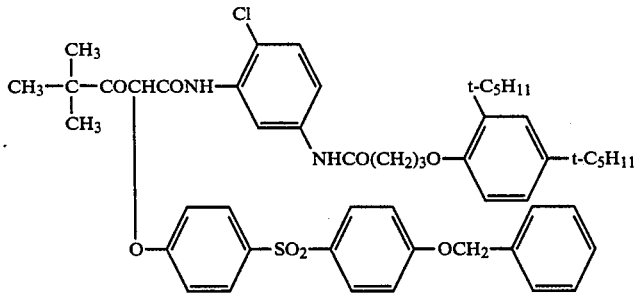

-continued
[Y - 9]
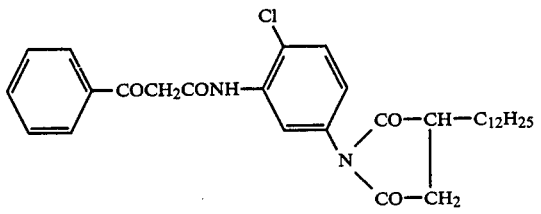
[Y - 10]
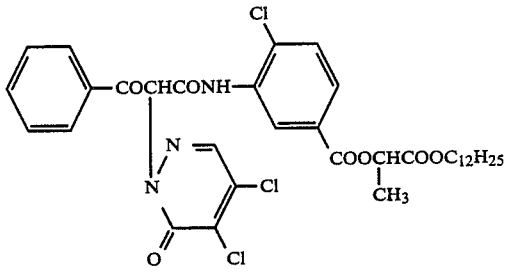
[Y - 11]
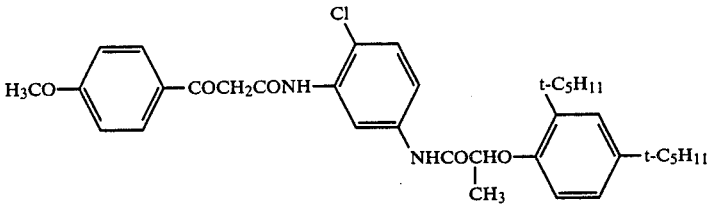
[Y - 12]
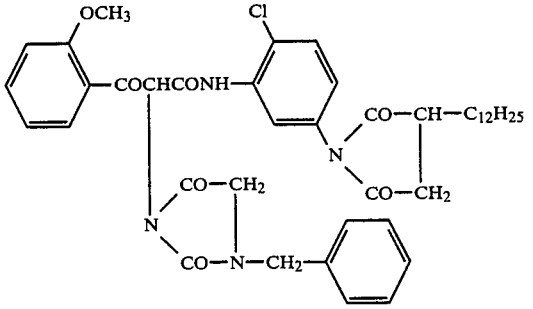
[Y - 13]
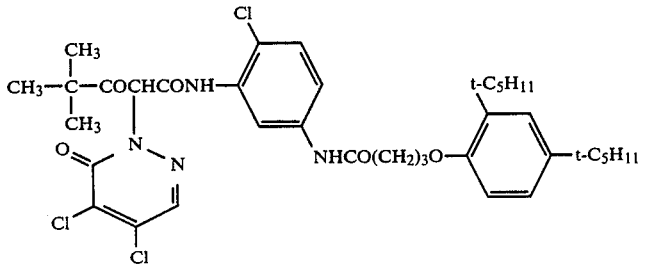
[Y - 14]
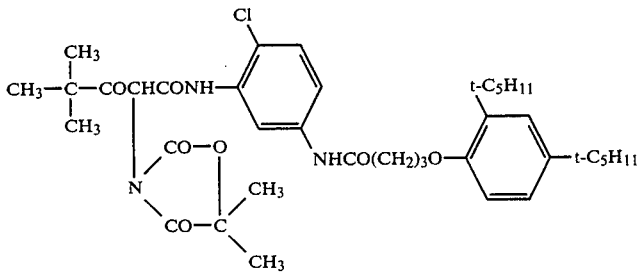

-continued
[Y - 15]
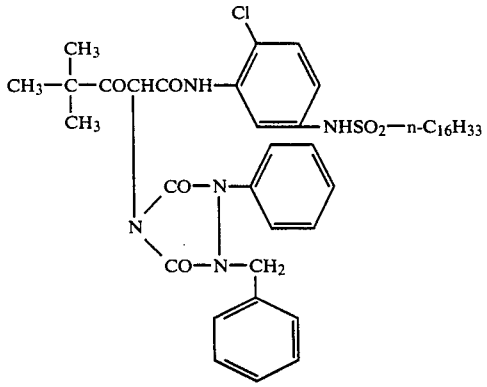
[Y - 16]
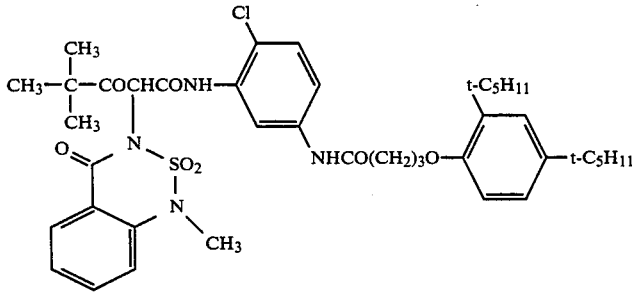
[Y - 17]
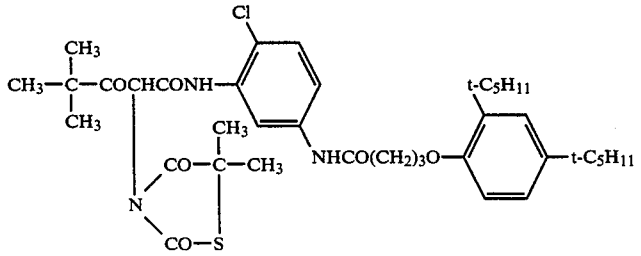
[Y - 18]
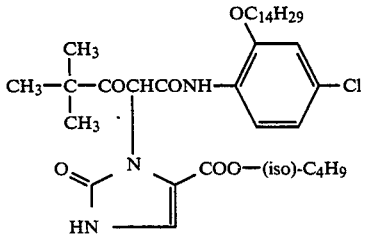
[Y - 19]
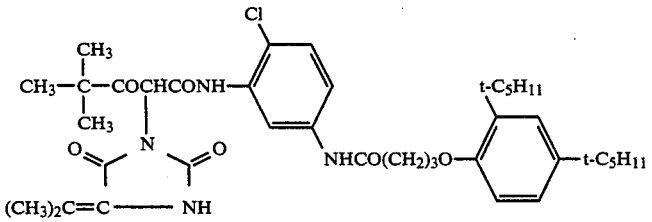

-continued

[Y - 20]

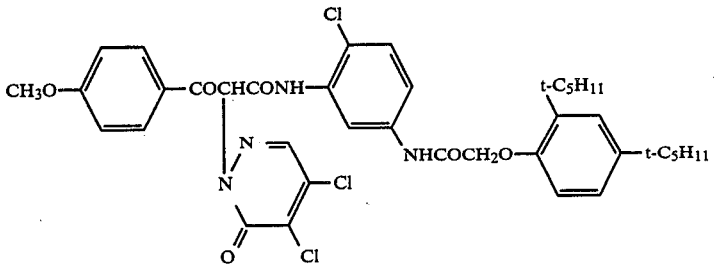

[Y - 21]

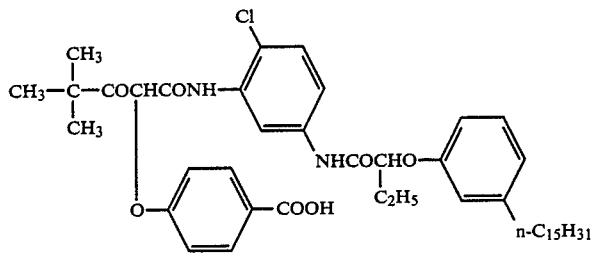

[Y - 22]

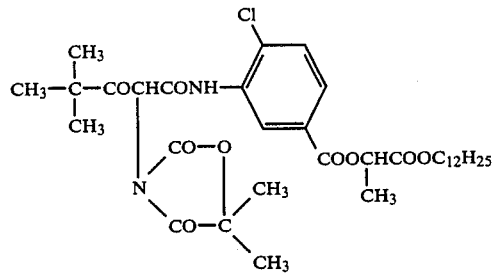

[Y - 23]

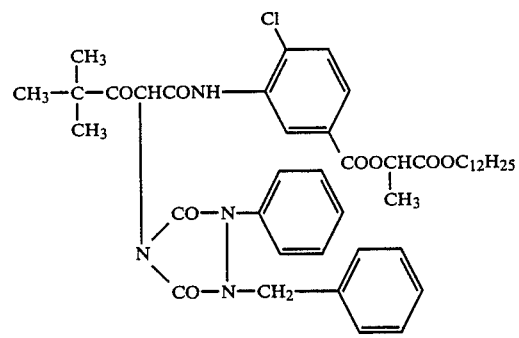

The above-described α-acylacetamide yellow couplers used in the present invention can be prepared by the methods described for example in West German Offenlegungsschrift Nos. 2,057,941 and 2,163,812, Japanese Provisional Patent Publication Nos. 26133/1972 and 29432/1973, U.S. Pat. Nos. 3,227,550, 2,875,057 and 3,265,506, Japanese Provisional Patent Publication Nos. 66834/1973, 66835/1973, 94432/1973, 1229/1973, 10736/1974, 34232/1975, 65231/1975, 117423/1975, 3631/1976 and 50734/1976.

The α-acylacetamide yellow couplers may be contained in the silver halide emulsion layer individually or as a mixture of two or more couplers. They may be incorporated by the above-mentioned procedures in an amount 1–30 mole % of blue-sensitive silver halide.

Typical examples of the cyan couplers used in the present invention are:

[C - 1]

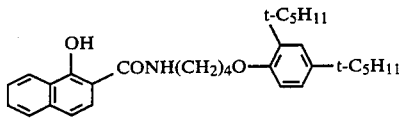

[C - 2]

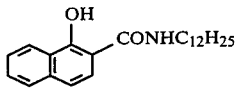

[C - 3]

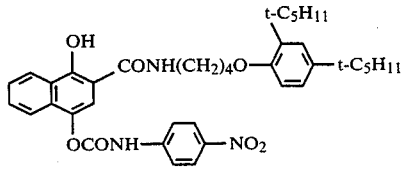

-continued
[C - 4]
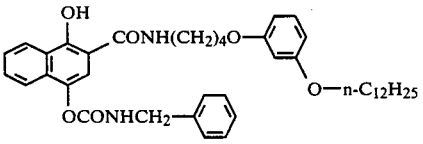
[C - 5]
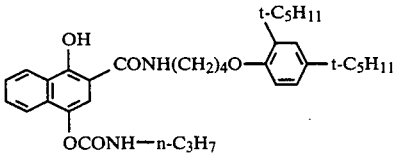
[C - 6]
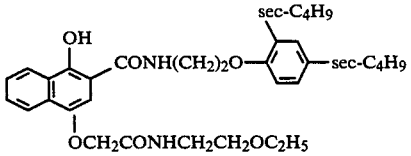
[C - 7]
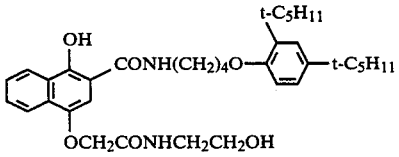
[C - 8]
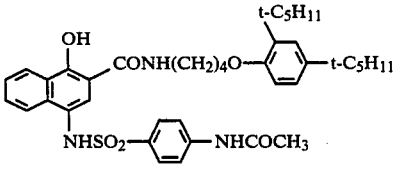
[C - 9]
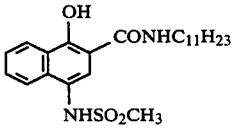
[C - 10]
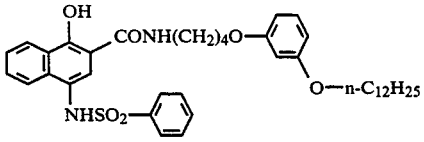
[C - 11]
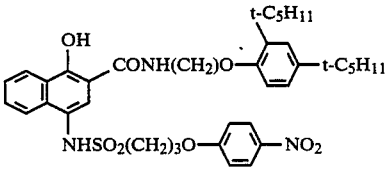
[C - 12]
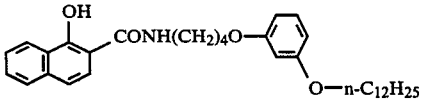
[C - 13]
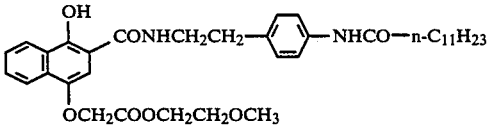
-continued
[C - 14]
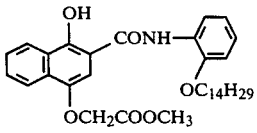
[C - 15]
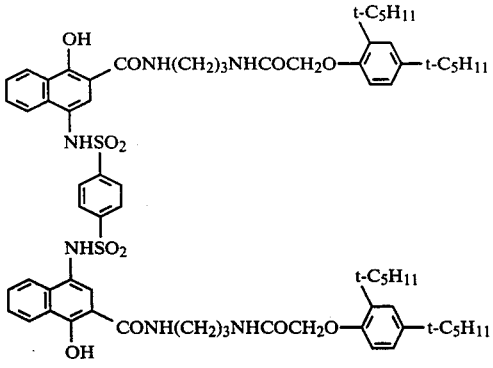
[C - 16]
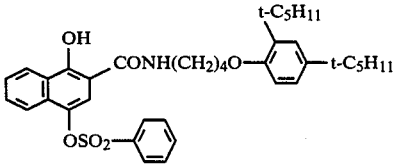
[C - 17]
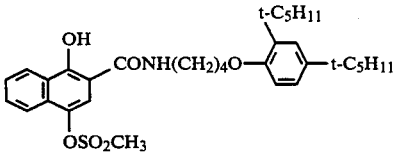
[C - 18]
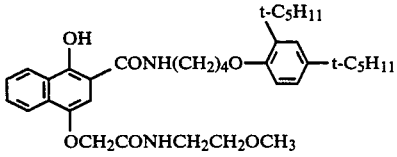
[C - 19]
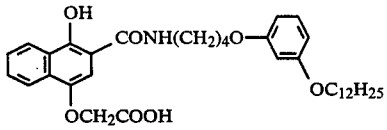
[C - 20]
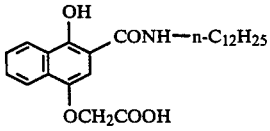
[C - 21]
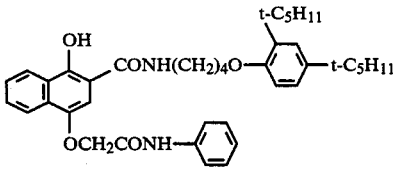
[C - 22]
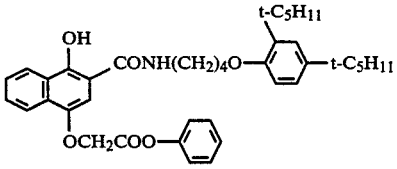

-continued

[C - 23]

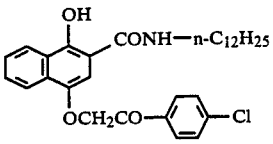

[C - 24]

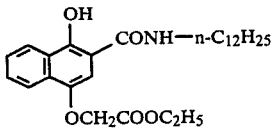

[C - 25]

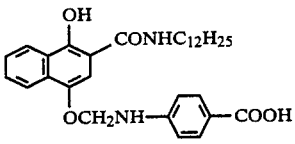

[C - 26]

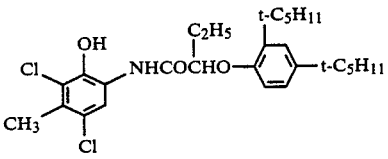

[C - 27]

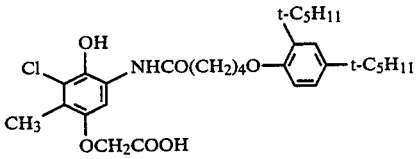

[C - 28]

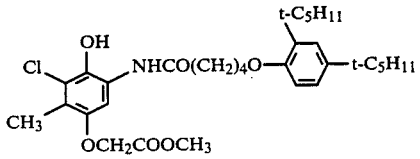

[C - 29]

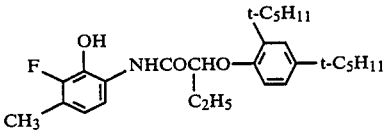

-continued

[C - 30]

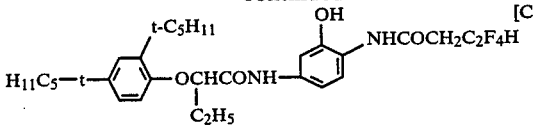

[C - 31]

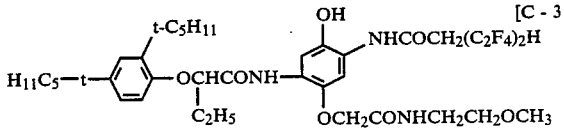

[C - 32]

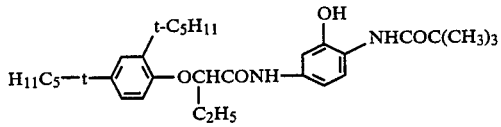

[C - 33]

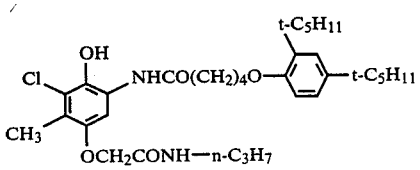

[C - 34]

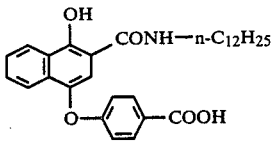

[C - 35]

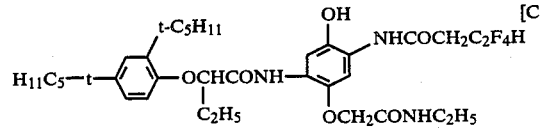

The cyan couplers used in the present invention can be prepared by the methods described for example in British Pat. No. 1,084,480, Japanese Provisional Patent Publication Nos. 117422/1975, 10135/1975, 37647/1976, 25228/1975 and 130441/1975. They are contained alone or in combination in the silver halide emulsion layer or contained in admixture with a so-called active-point arylazo-substituted colored coupler as described in U.S. Pat. No. 3,034,892, etc. They are incorporated by conventional procedure in an amount between 1 and 30 mole % of silver halide.

Examples of the preferable magenta couplers used in the present invention are:

[M-1]

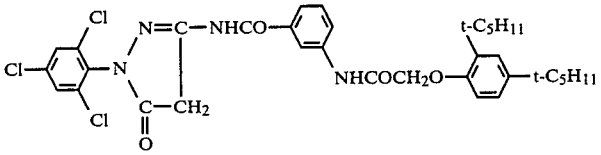

[M-2]

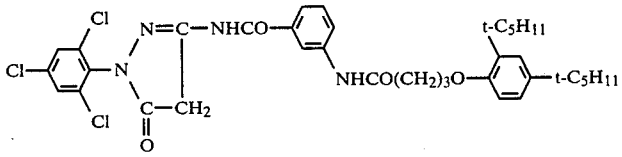

-continued
[M-3]
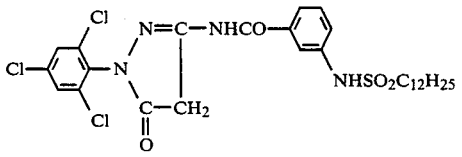
[M-4]
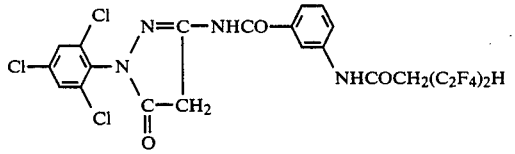
[M-5]
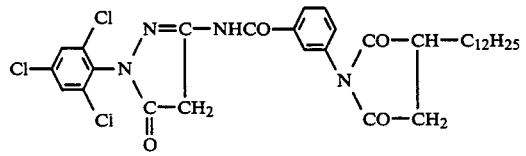
[M-6]
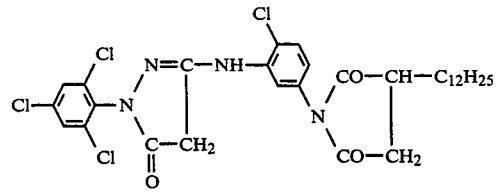
[M-7]
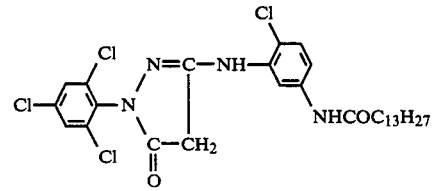
[M-8]
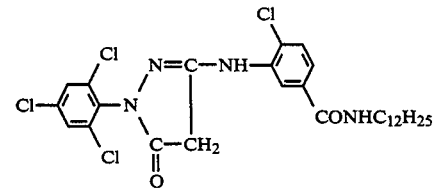
[M-9]
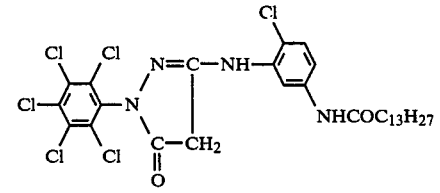
[M-10]
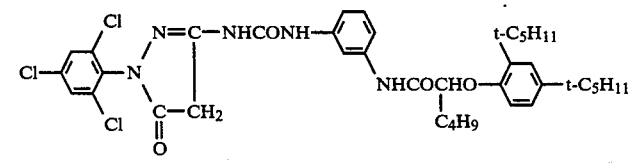

-continued
[M-11]
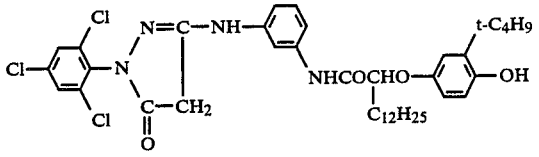
[M-12]
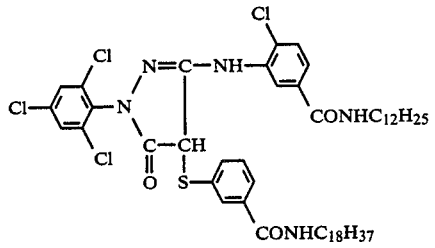
[M-13]
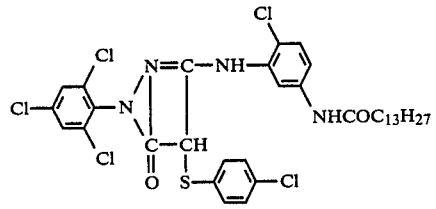
[M-14]
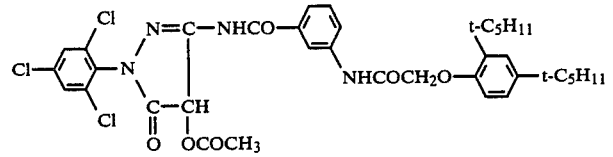
[M-15]
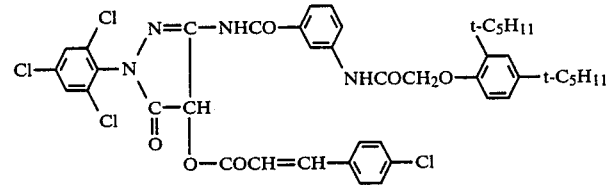
[M-16]
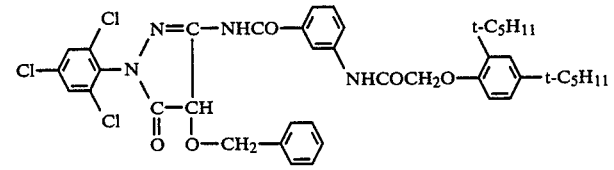
[M-17]
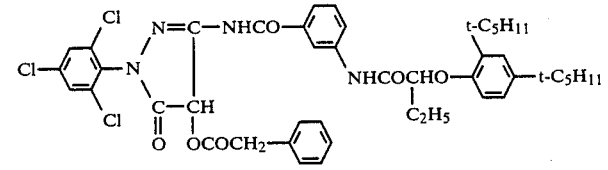
[M-18]
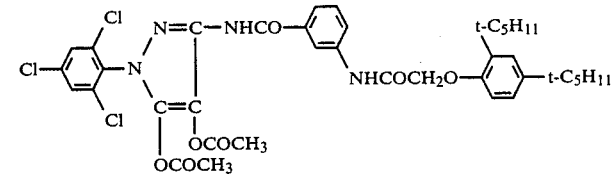

-continued
[M-19]
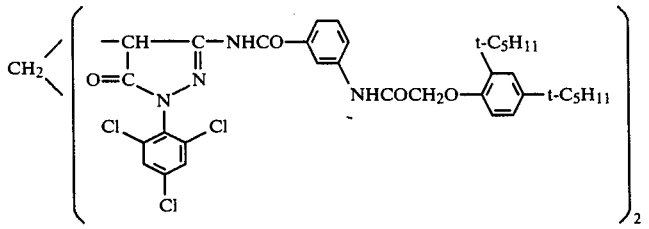
[M-20]
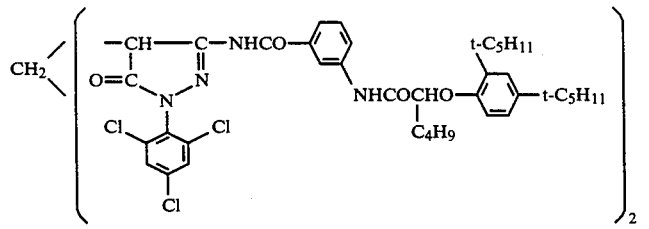
[M-21]
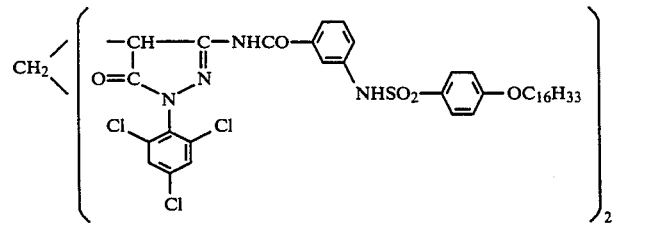
[M-22]
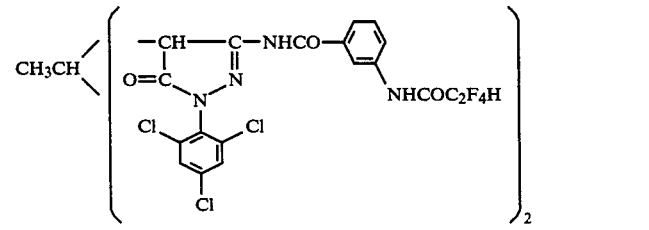
[M-23]
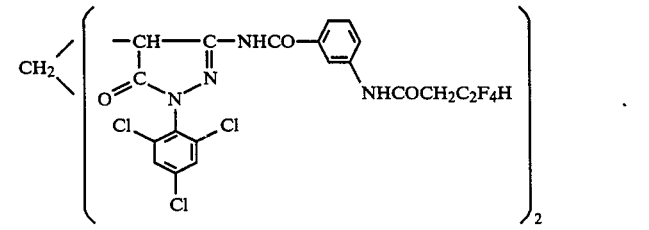
[M-24]
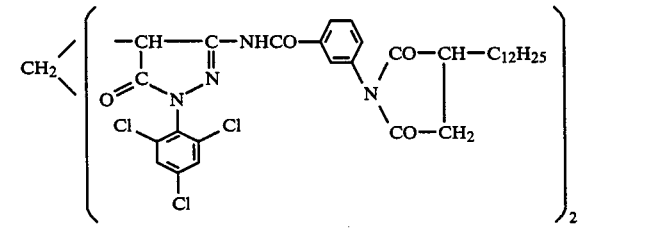

-continued
[M-25]
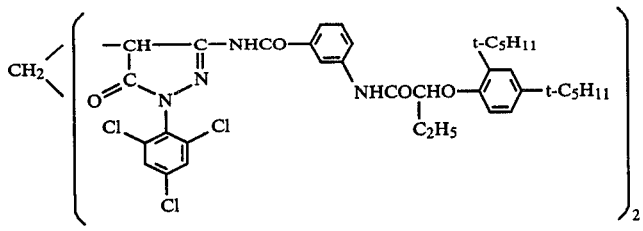
[M-26]
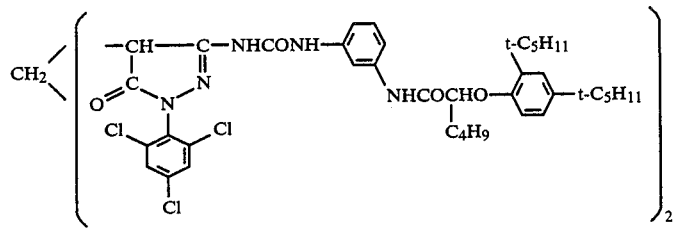
[M-27]
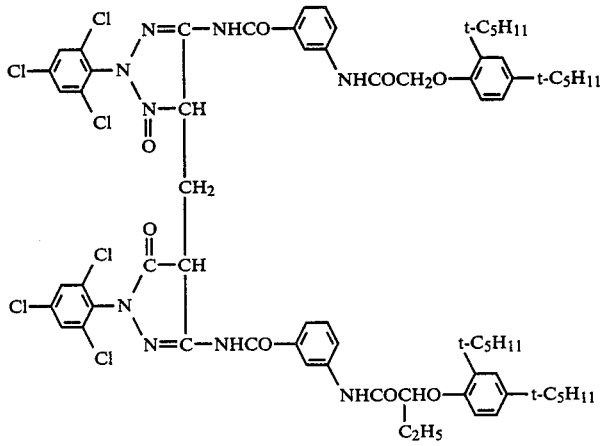
[M-28]
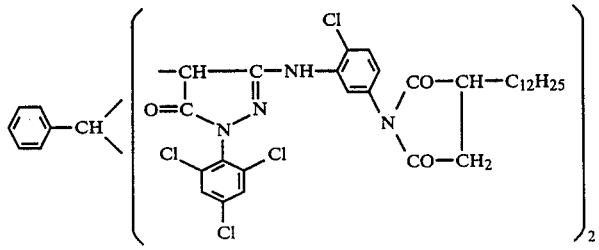
[M-29]
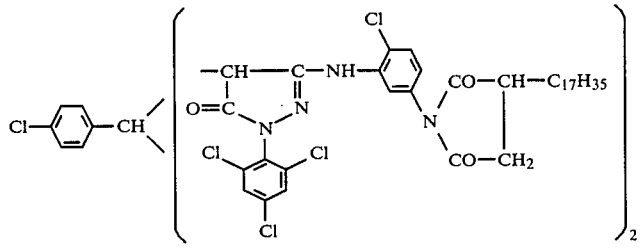

-continued
[M-30]
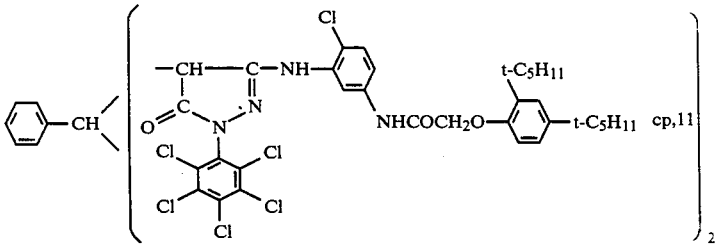
[M-31]
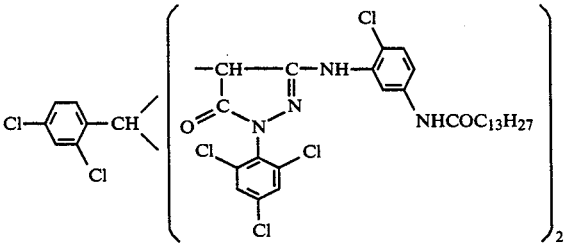
[M-32]
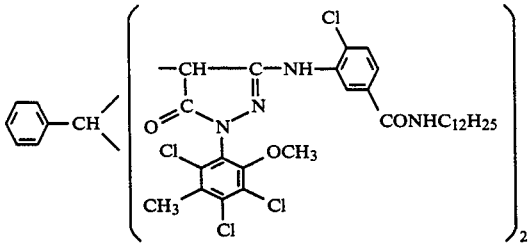
[M-33]
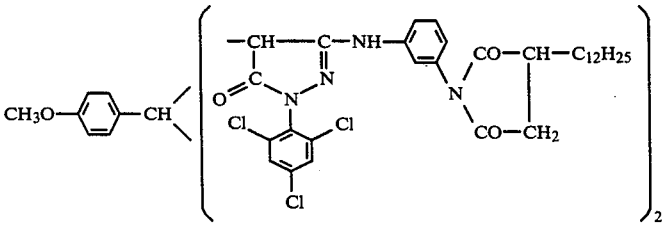
[M-34]
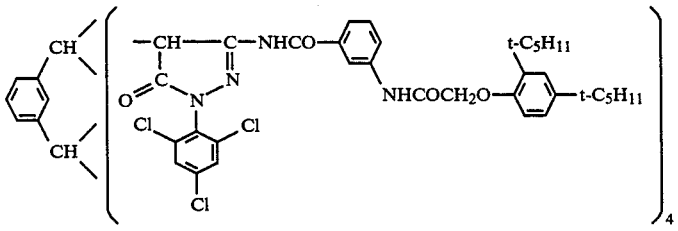
[M-35]
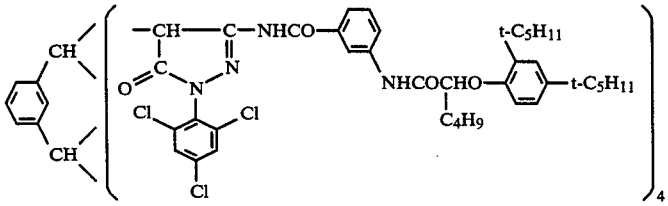

-continued
[M-36]
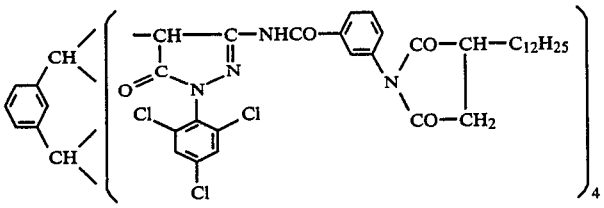
[M-37]
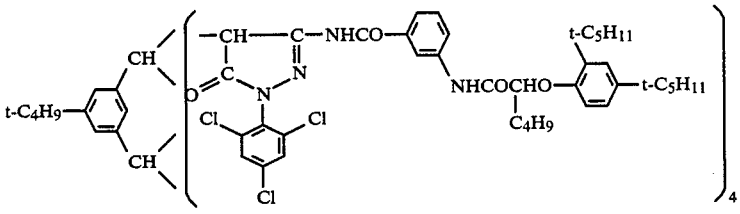
[M-38]
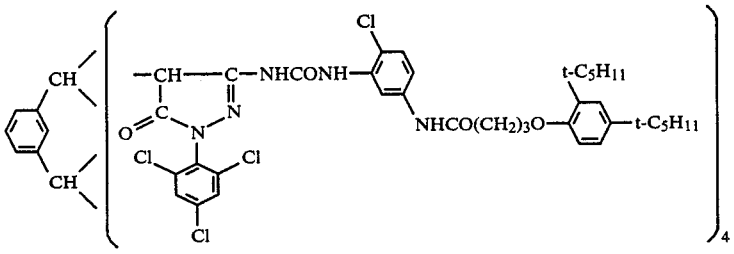
[M-39]
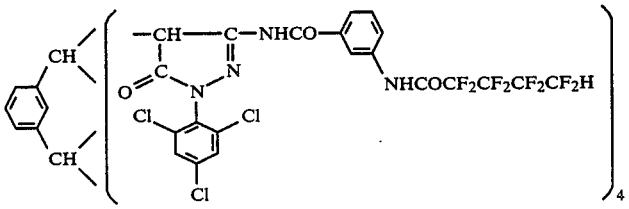
[M-40]
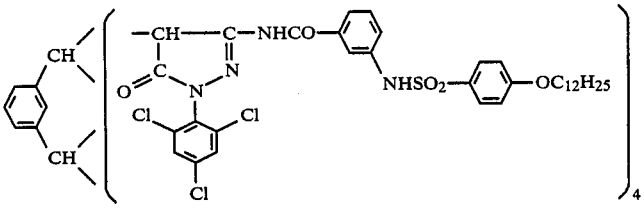
[M-41]
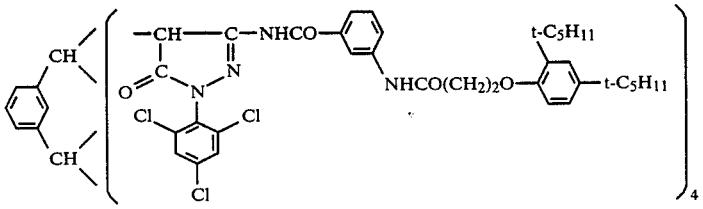
[M-42]
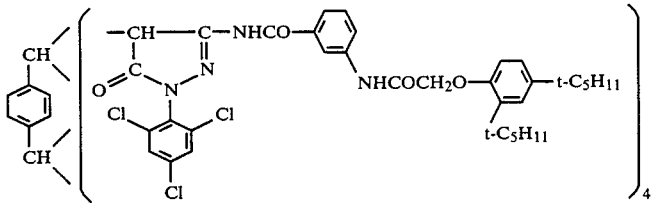

The magenta couplers used in the present invention also includes those described for example in U.S. Pat. Nos. 3,311,476, 3,419,391, 3,888,680 and 2,618,641, West German Offenlegungsschrift Nos. 20 15 814, 23 57 105 and 23 57 122, Japanese Provisional Patent Publication Nos. 129538/1974, 105820/1976, 12555/1979, 48540/1979, 112342/1976, 112343/1976, 108842/1976 and 58533/1977. The methods of preparing them are also described in these literatures.

As for the coupler used in the present invention, it is preferable that the speed of the reaction between the coupler and the oxidized product of the developing agent is high because in this case the number of dye molecules formed per unit amount of developed silver increases. Particularly, couplers exhibiting a specific rate, as measured by the method described below, which is higher than that of the compound M-1 are preferable.

(Measurement of specific rate)

In 30 ml of ethyl acetate and 15 ml of dibutyl phthalate, 0.02 mole of a coupler is dissolved. The solution thus obtained is mixed with 20 ml of a 10% aqueous solution of Alkanol B (alkylnaphthalenesulfonate available from du Pont) and 200 ml of a 5% aqueous gelatin solution. The mixture is then emulsified and dispersed in a colloid mill. The dispersion thus obtained is then added to a silver iodobromide emulsion containing 3.5 mole % of silver iodide so that the mole percentage of the coupler with respect to silver in the emulsion is 10%. The composition thus obtained is then applied to a triacetate film so that the silver amount is 15 mg/dm$^2$, and dried to yield a specimen. The obtained specimen is exposed through an optical wedge and processed according to the processes described below by using the processing solutions described below.

The percentage of the maximum density obtained with a color developing solution containing citrazinic acid with respect to the maximum density obtained with a color developing solution containing no cirtazinic acid is taken as the specific rate.

| Processing (processing temperature: 38° C.) | Processing time |
|---|---|
| Color development | 3 minutes 15 seconds |
| Bleaching | 6 minutes 30 seconds |
| Washing with water | 3 minutes 15 seconds |
| Fixing | 6 minutes 30 seconds |
| Washing with water | 3 minutes 15 seconds |
| Stabilization | 1 minute 30 seconds |
| Drying | |

Compositions of the processing solutions were used in the processing steps:

| (Developing solution containing no citrazinic acid) | |
|---|---|
| 4-Amino-3-methyl-N—ethyl-N—(β-hydroxyethyl)-aniline sulfate | 4.75 g |
| Anhydrous sodium sulfite | 4.25 g |
| Hydroxylamine half-sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Made up to 1 liter with water, and adjusted | |

-continued

| (Developing solution containing no citrazinic acid) | |
|---|---|
| to pH 10.3 with a IN aqueous potassium hydroxide or acetic acid. | |

(Developing solution containing citrazinic acid)

Citrazinic acid is added to the developing solution containing no citrazinic acid in an amount of 5 g per liter, and the resulting solution is adjusted to pH 10.3.

| | |
|---|---|
| (Bleaching solution) | |
| Ferric ammonium salt of ethylenediaminetetraacetic acid | 100.0 g |
| Diammonium salt of ethylenediaminetetraacetic acid | 10.0 g |
| Ammonium bromide | 150.0 g |
| Glacial acetic acid | 10.0 ml |
| Made up to 1 liter with water and adjusted to pH 6.0 with aqueous ammonia. | |
| (Fixing solution) | |
| Ammonium thiosulfate | 175.0 g |
| Anhydrous sodium sulfite | 8.6 g |
| Sodium metasulfite | 2.3 g |
| Made up to 1 liter with water and adjusted to pH 6.0 with acetic acid. | |
| (Stabilizing solution) | |
| Formalin (37% aqueous solution) | 1.5 ml |
| Konidax (available from Konishiroku Photo Industry Co., Ltd.) | 7.5 ml |
| Made up to 1 liter with water. | |

In the light-sensitive color photographic material in accordance with the present invention, it is preferable that at least one of the light-sensitive layers contain a compound releasing a development inhibitor by the reaction with an oxidized product of the color developing agent. By using such a compound, the sharpness, graininess, color purity and wide latitude of exposure are remarkably improved over the conventional light-sensitive color photographic material.

Examples of known compounds releasing a development inhibitor by the the reaction with an oxidized product of the developing agent are compounds which couple with an oxidized product of a color developing agent to form a dye and release a development inhibitor (hereinafter referred to as the DIR couplers) as disclosed in U.S. Pat. Nos. 3,148,062 and 3,227,554, and compounds which release a development inhibitor without forming a dye by the coupling with an oxidized product of a color developing agent (hereinafter referred to as the DIR substances) as disclosed in U.S. Pat. No. 3,632,345. (Both DIR couplers and DIR substances are referred to as the DIR compounds.)

For example, when the present invention is applied to an ordinary multi-layer light-sensitive color photographic material containing a blue-, green- and red-sensitive emulsion layers, the DIR compounds should be contained in one or more of these layers. Particularly, it is preferable that they are contained at least in the green-sensitive emulsion layer. Further, when an emulsion layer exhibiting a color sensitivity comprises a plurality of layers exhibiting different sensitivities as in the present invention, the DIR compounds should be contained in at least one of the layers, preferably in the emulsion having a lower sensitivity.

The DIR compounds preferably used in the present invention are represented by the following general formula (I) or (II):

A—TIME—Z (I)

In the general formula (I), A designates a coupling component capable of reacting with an oxidized product of a color developing agent. The coupling component may be any component which can release the group TIME-Z by the reaction with an oxidized product of a color developing agent.

In the general formula (I), TIME designates a timing group, and Z designates a development inhibitor. Examples of the timing groups includes those based on the intramolecular nucleophilic substitution as described in Japanese Provisional Patent Publication No. 145135/1979, and those based on the electron movement along the conjugated chain as described in Japanese Provisional Patent Publication No. 17644/1980. In short, any compound may be used if it first releases the group TIME-Z through the breakage of the A-TIME bond and then releases Z through the breakage of the TIME-Z bond. Z includes the development inhibitors as described in "Research Disclosure", Vol. 176, No. 17643, December 1978 (hereinafter referred to as the literature l). Preferably, it is mercaptotetrazole, selenotetrazole, mercaptobenzothiazole, selenobenzothiazole, mercaptobenzoxazole, selenobenzoxazole, mercaptobenzimidazole, selenobenzimidazole, benzotriazole, benzodiazole or a derivative thereof.

A—Z (II)

In the general formula (II), A and Z have the same meanings as described above with respect to the general formula (I).

Syntheses of the compounds represented by the general formula (I) are described for example in Japanese Provisional Patent Publication Nos. 14513/1979 and 17644/1980.

The DIR compounds represented by the general formula (II) involve the DIR couplers and the DIR substances. Examples of the DIR couplers represented by the general formula (II) are described e.g. in U.S. Pat. Nos. 3,227,554 and 3,773,201, and British Pat. No. 2,010,818. Syntheses thereof are also described in these patents.

Examples of the DIR substances represented by the general formula (II) are described e.g. in U.S. Pat. Nos. 3,958,993, 3,961,959 and 3,938,996, Japanese Provisional Patent Publication Nos. 147716/1975, 152731/1975, 105819/1976, 6724/1976 and 123025/1975, U.S. Pat. Nos. 3,928,041 and 3,632,345, and Japanese Provisional Patent Publication No. 125202/1975. Syntheses thereof are also described in these specifications.

-continued

[D-1]

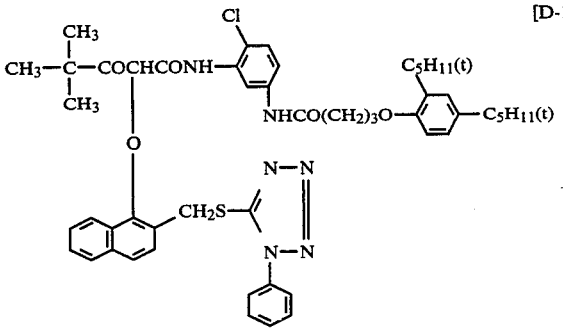

[D-2]

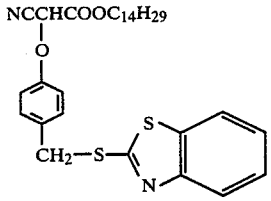

[D-3]

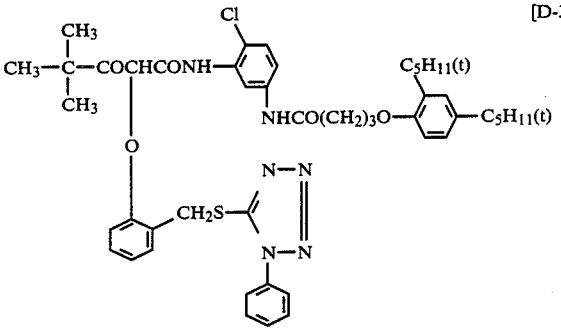

[D-4]

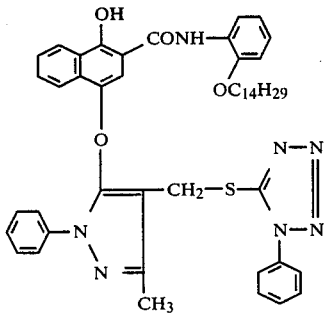

-continued
[D-5]
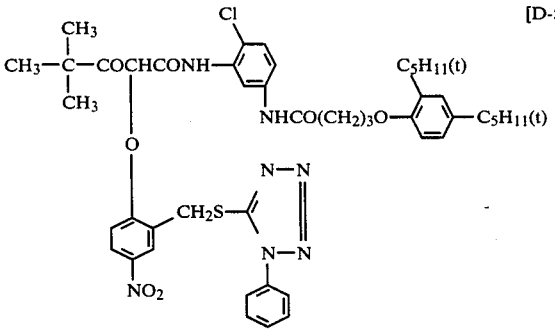
[D-6]
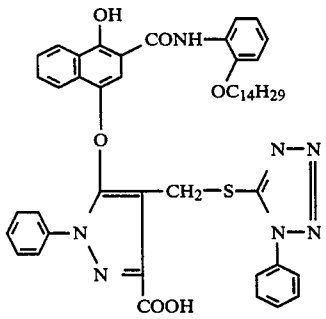
[D-7]
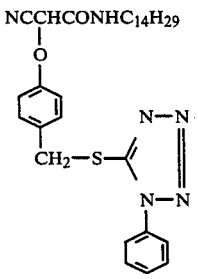
[D-8]
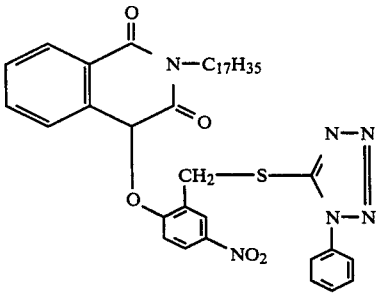
-continued
[D-9]
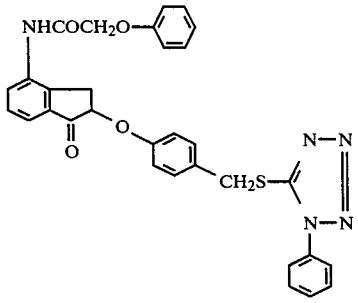
[D-10]
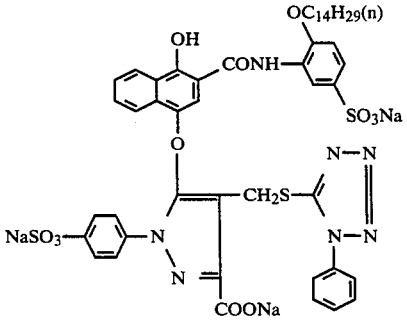
[D-11]
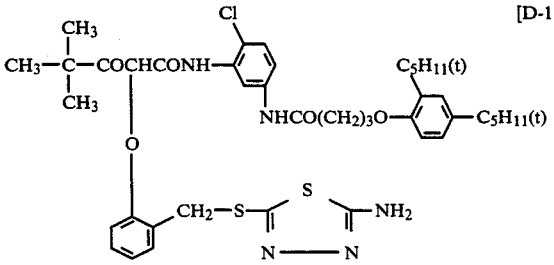
[D-12]
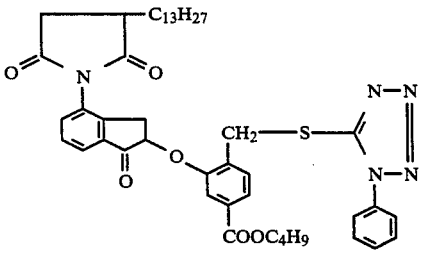

-continued
[D-13]
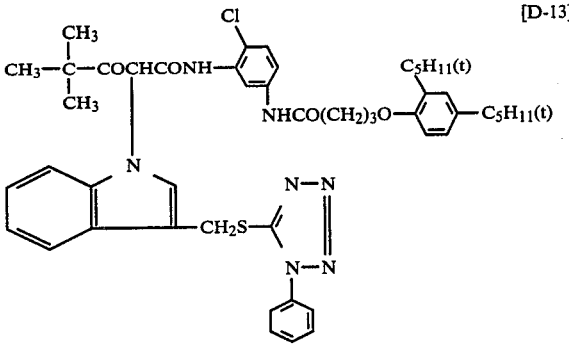
[D-14]
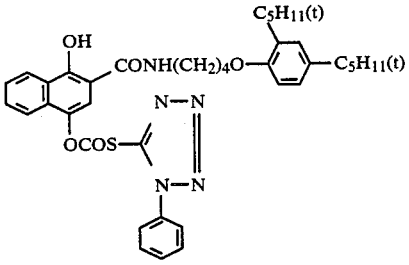
[D-15]
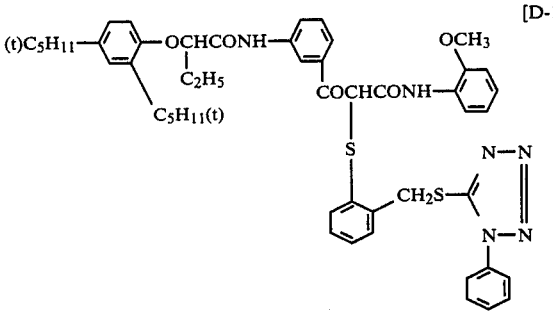
[D-16]
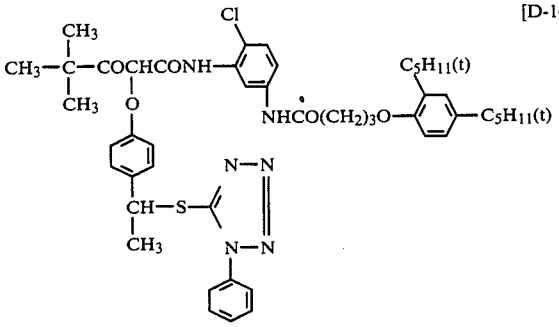
-continued
[D-17]
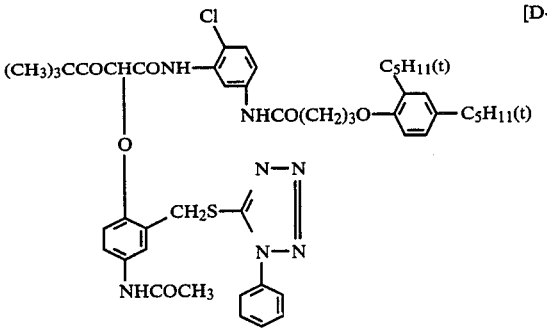
[D-18]
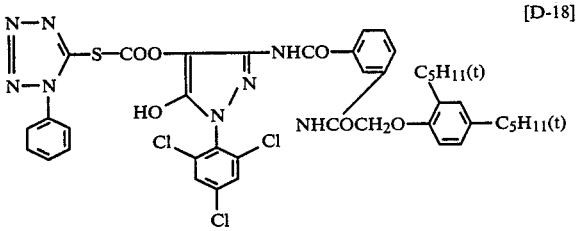
[D-19]
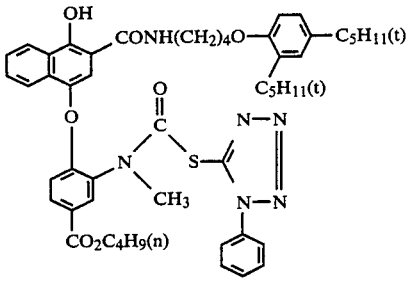
[D-20]
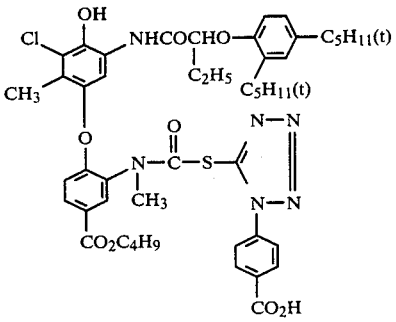

-continued
[D-21]
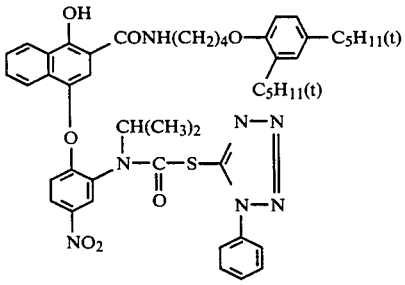
[D-22]
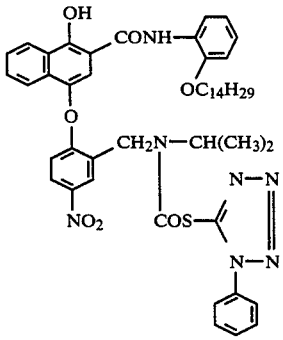
[D-23]
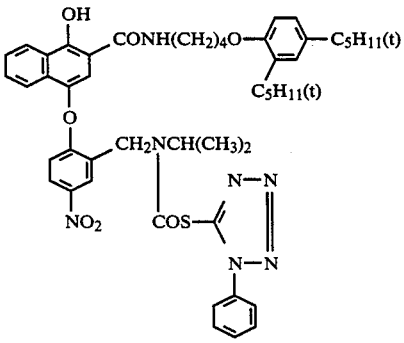
[D-24]~[D-31]
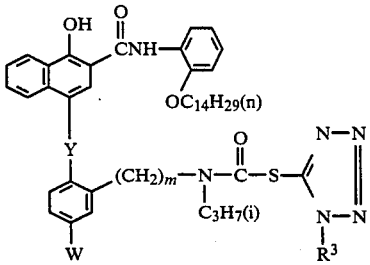
In the formula for [D-24]~[D-31], Y, W, m and $R^3$ each represent the following:
| Compound No. | Y | W | m | $R_3$ |
|---|---|---|---|---|
| [D-24] | O | $NO_2$ | 0 | 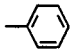 |
| [D-25] | S | $NO_2$ | 1 | 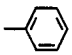 |
| [D-26] | O | $NO_2$ | 1 | 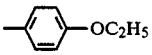 |
| [D-27] | O | $NO_2$ | 1 | 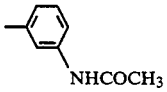 |
| [D-28] | O | $NO_2$ | 1 | 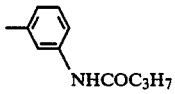 |
| [D-29] | O | $-NHSO_2C_4H_9$ | 0 | 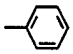 |
| [D-30] | O | $-NHSO_2C_8H_{17}$ | 1 | 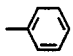 |
| [D-31] | S | H | 0 | 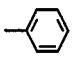 |
[D-32]~[D-36]
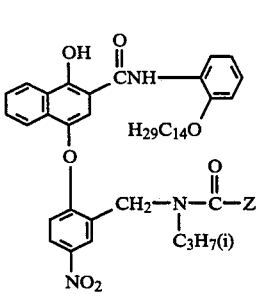

| Compound No. | Y | W | m | $R_3$ |
|---|---|---|---|---|
In [D-32]~[D-36], Z represents the following:
| Compound No. | |
|---|---|
| [D-32] | ethylthiotetrazole |
| [D-33] | n-butylthiotetrazole |
| [D-34] | cyclohexylthiotetrazole |
| [D-35] | N—butylthiotetrazole |
| [D-36] | 5,6-dichlorobenzotriazole |
[D-37]
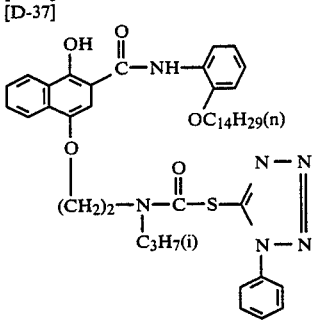
[D-38]
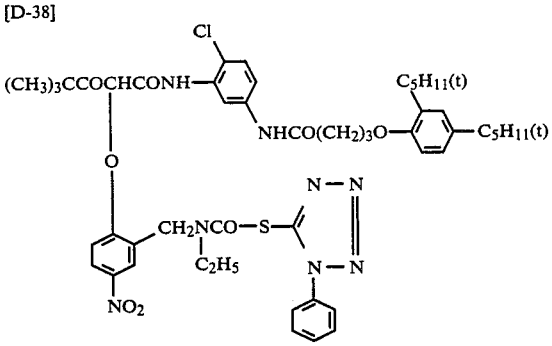
[D-39]
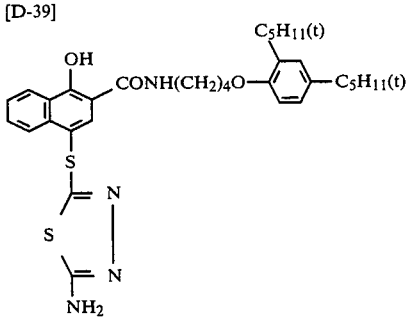
[D-40]
Compound No.
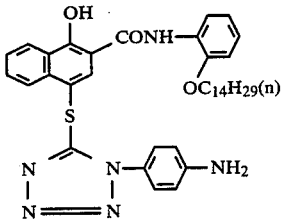
[D-41]
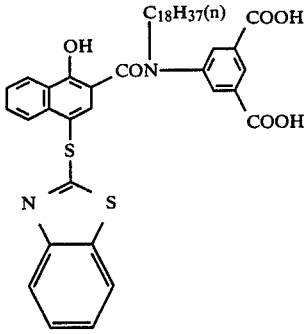
[D-42]
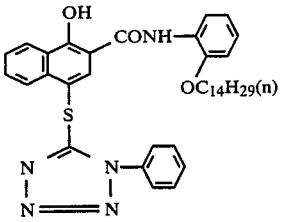
[D-43]
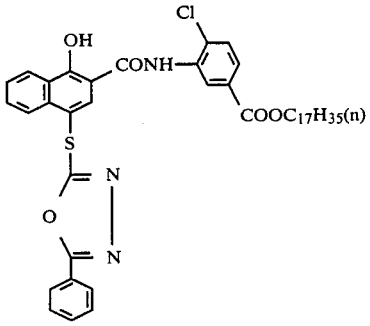
[D-44]

-continued
Compound No.
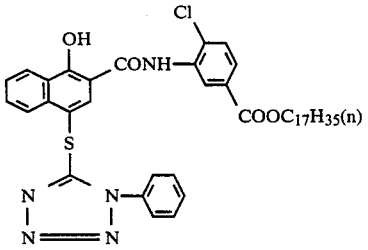
[D-45]
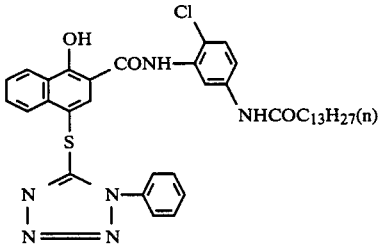
[D-46]
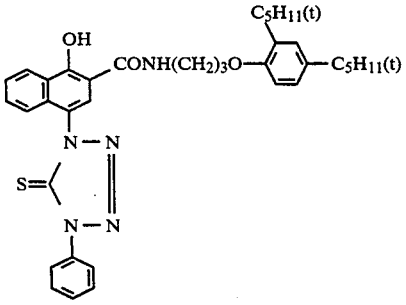
[D-47]
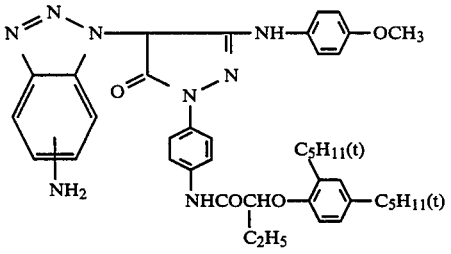
[D-48]
-continued
Compound No.
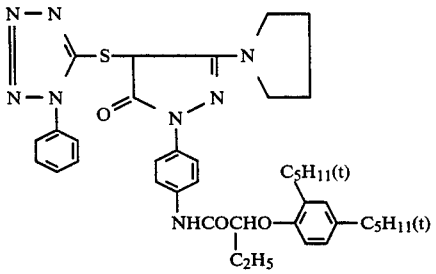
[D-49]
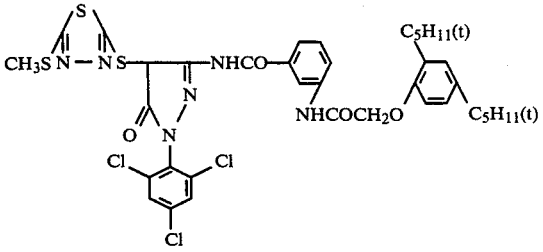
[D-50]
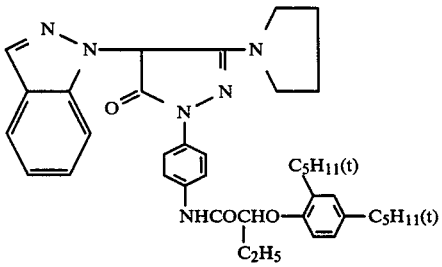
[D-51]
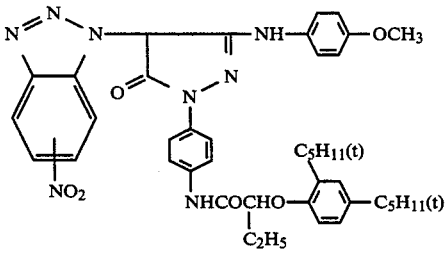
[D-52]

-continued
Compound No.
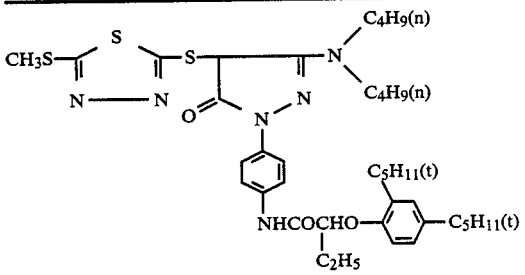
[D-53]
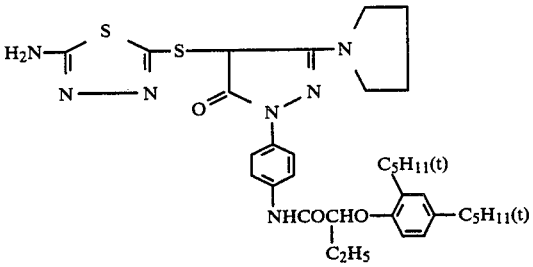
[D-54]
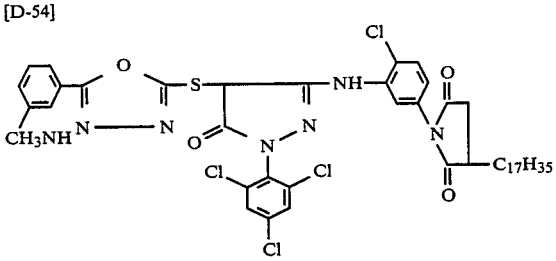
[D-55]
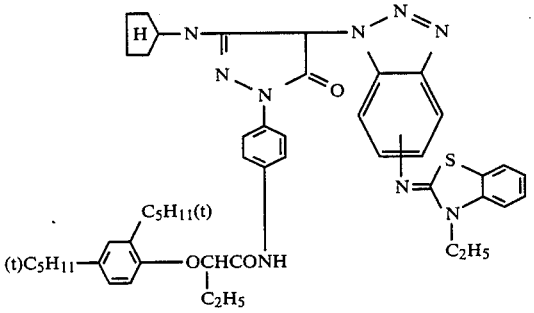
[D-56]
-continued
Compound No.
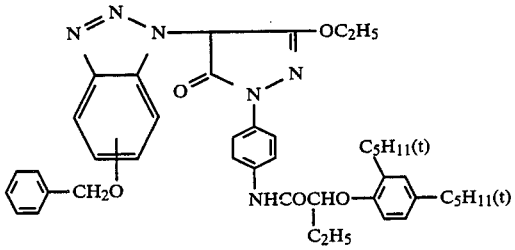
[D-57]
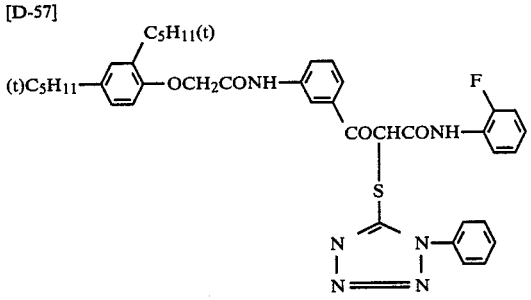
[D-58]
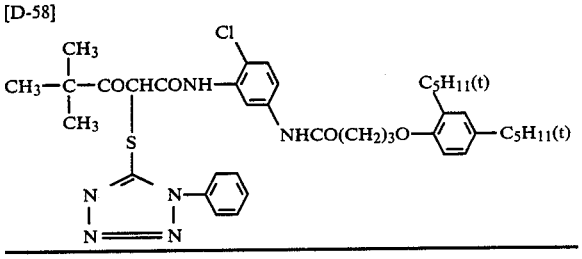
Compound No.
[D-59]
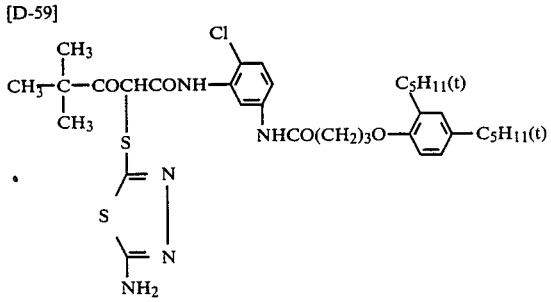
[D-60]

-continued
Compound No.
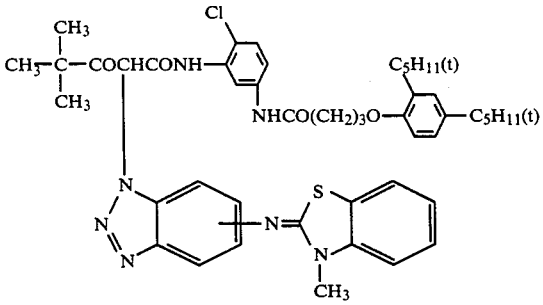
[D-61]
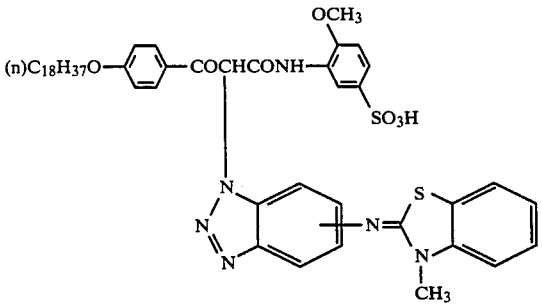
[D-62]
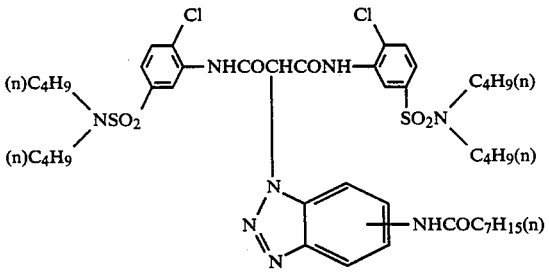
[D-63]
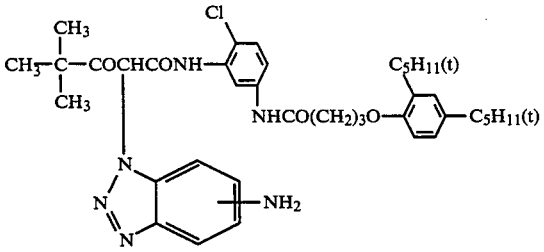
[D-64]
-continued
Compound No.
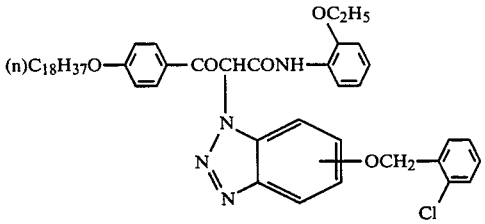
[D-65]
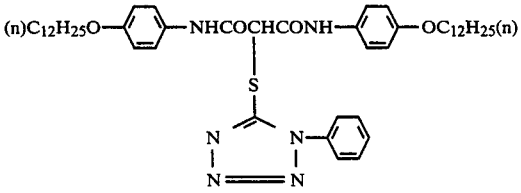
[D-66]
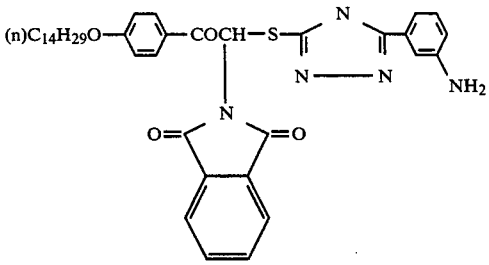
[D-67]
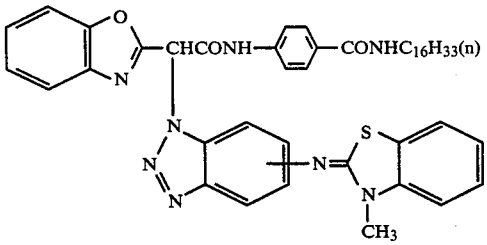
[D-68]
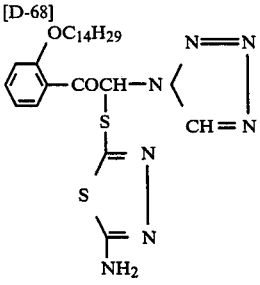

-continued
Compound No.
[D-69]
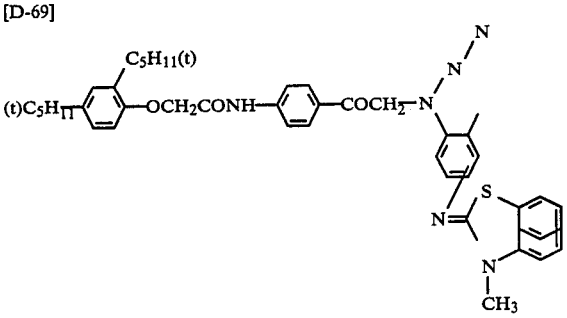
[D-70]
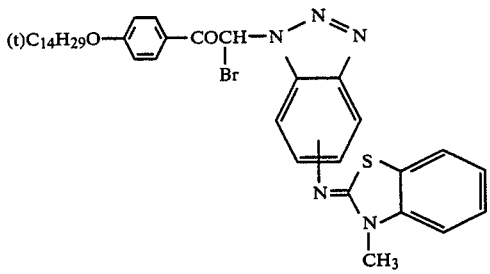
[D-71]
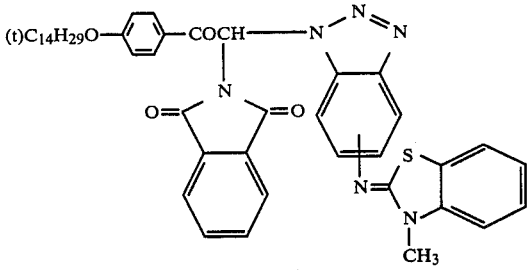
[D-72]
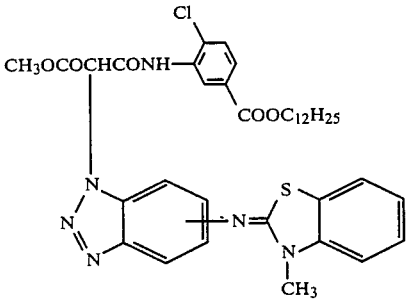
[D-73]
-continued
Compound No.
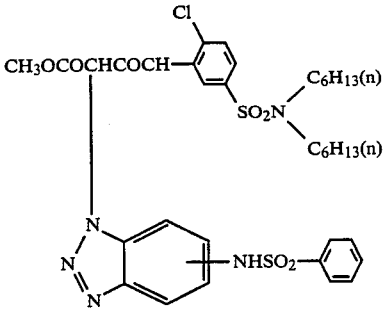
[D-74]
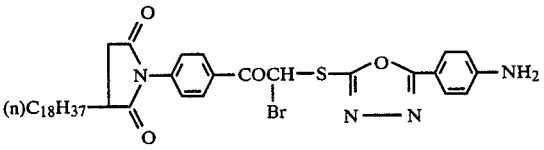
[D-75]
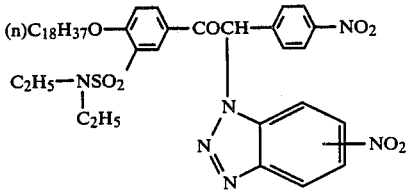
[D-76]
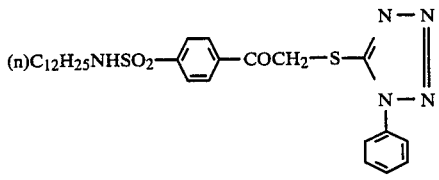
[D-77]
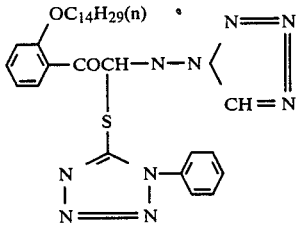
[D-78]

-continued
Compound No.
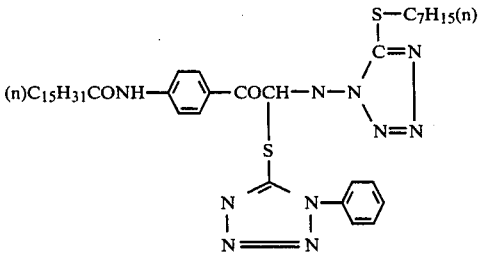
[D-79]
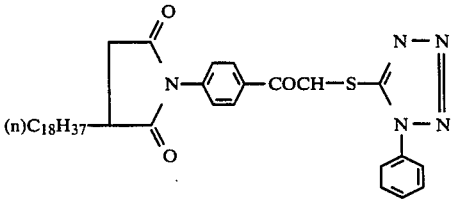
[D-80]
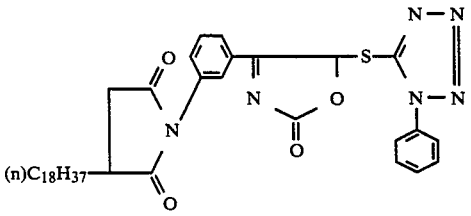
[D-81]
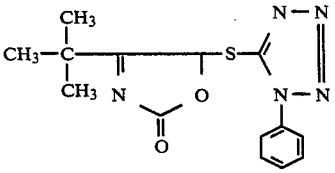
[D-82]
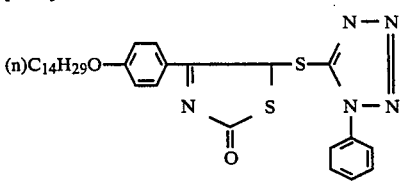
[D-83]
-continued
Compound No.
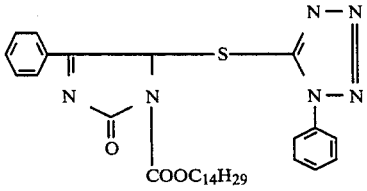
[D-84]
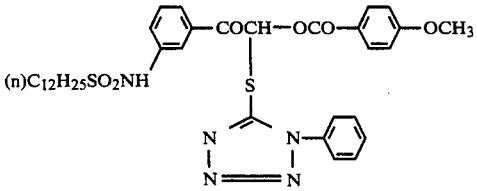
[D-85]
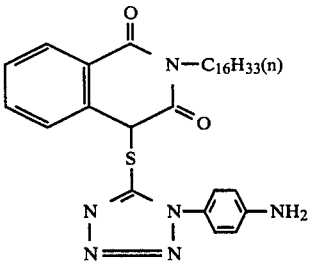
[D-86]
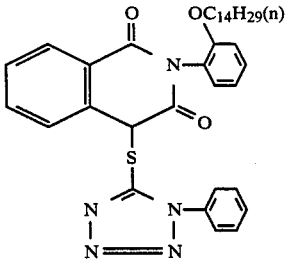
[D-87]
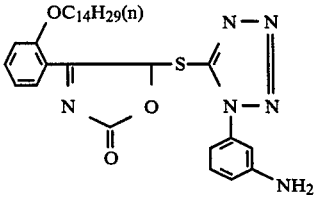
[D-88]

-continued
Compound No.
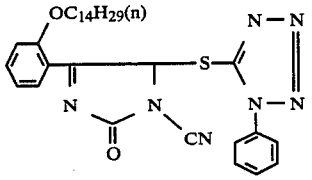
[D-89]
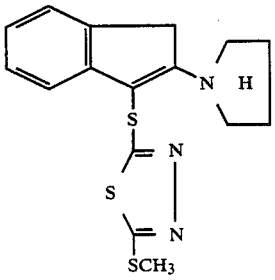
[D-90]
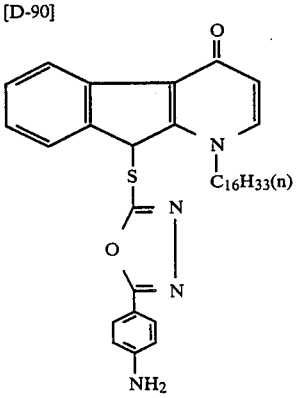
-continued
Compound No.
[D-91]
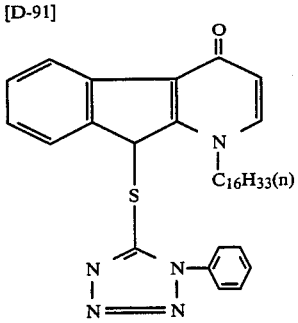
[D-92]
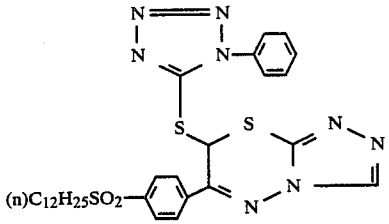
Compound No.
[D-93]
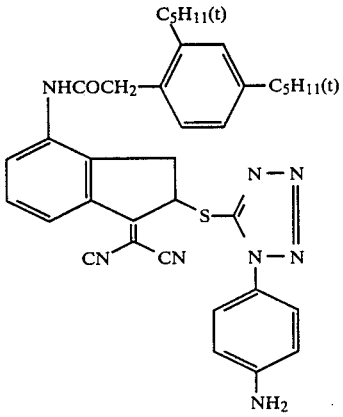
[D-94]
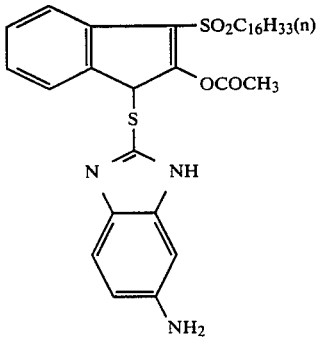
[D-95]
[D-96]

-continued
Compound No.
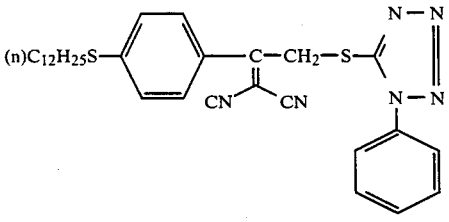
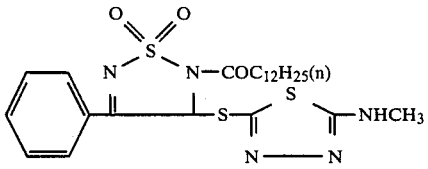
[D-97]
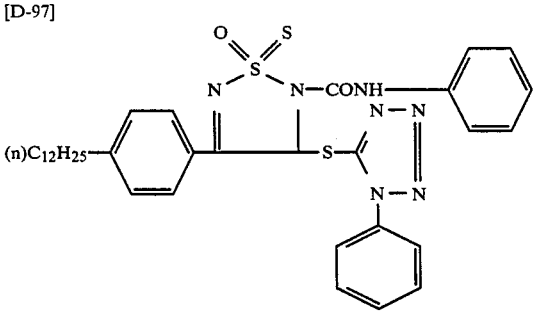
[D-98]
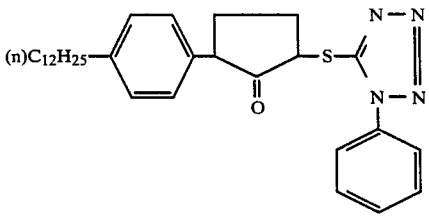
[D-99]
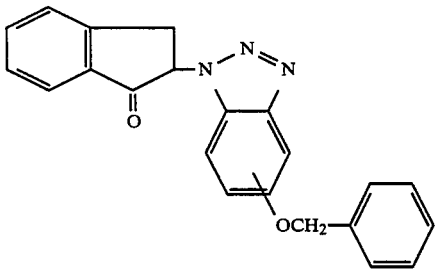
[D-100]
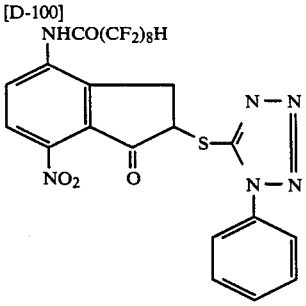
[D-101]
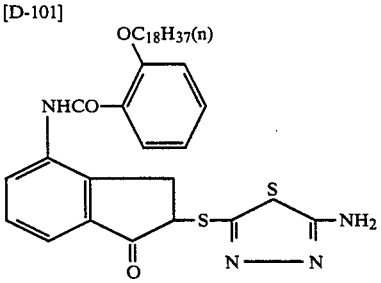
[D-102]
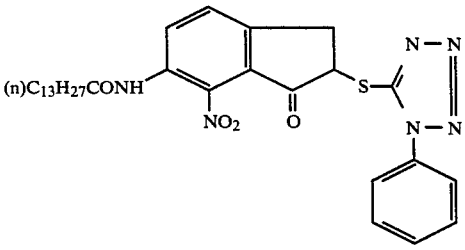
[D-103]
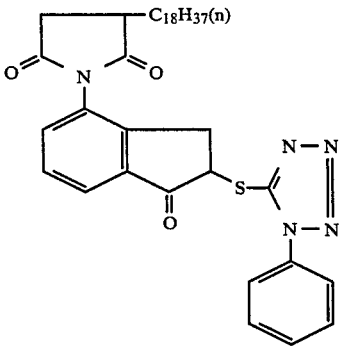
[D-104]
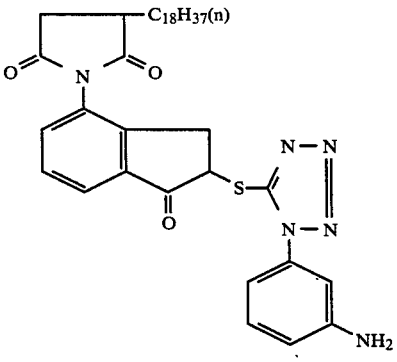

-continued
Compound No.
[D-105]
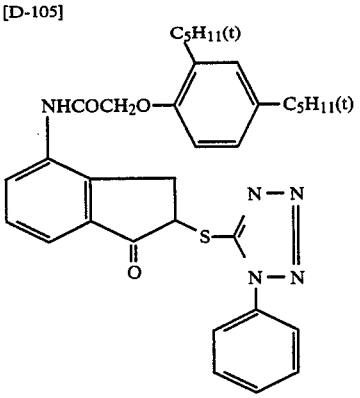
[D-106]
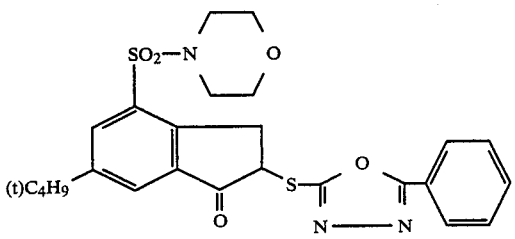
[D-107]
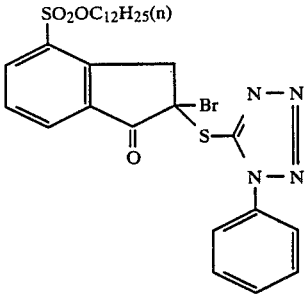
[D-108]
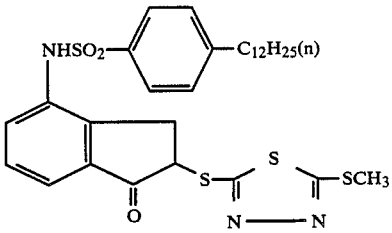
[D-109]
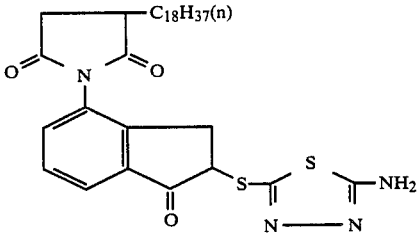
[D-110]
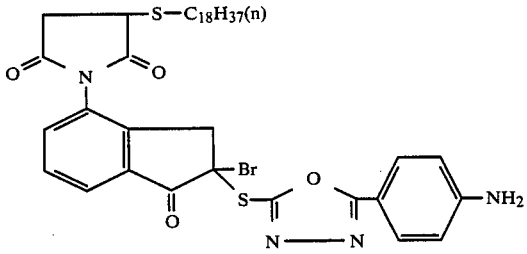
[D-111]
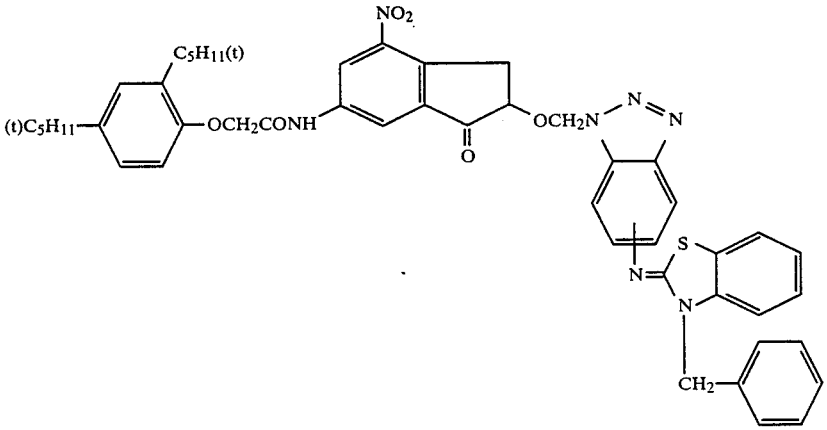
[D-112]
[D-113]

-continued
Compound No.
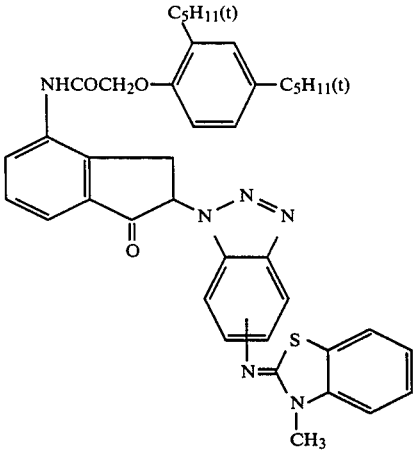
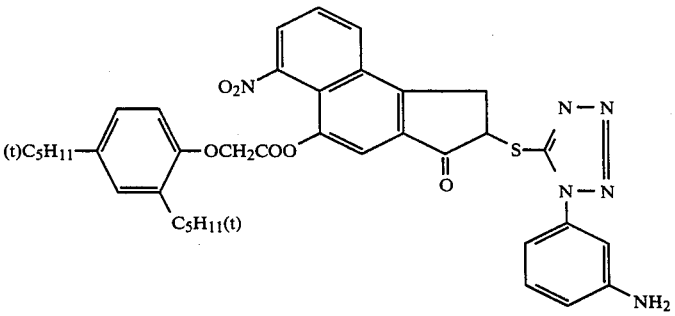
[D-114]
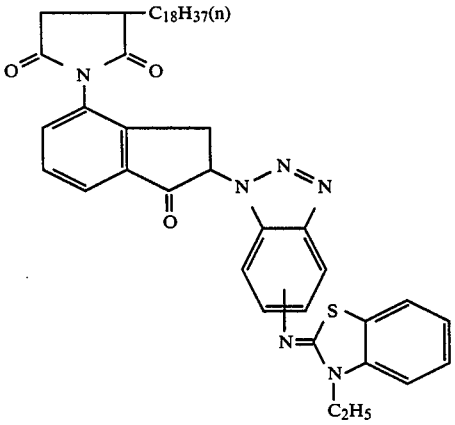
[D-115]
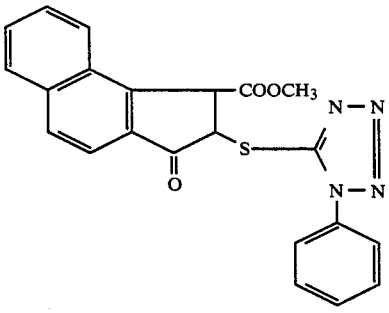
[D-116]
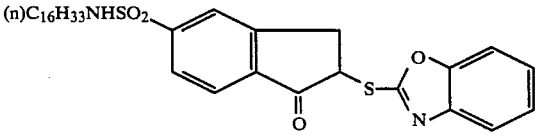
[D-117]
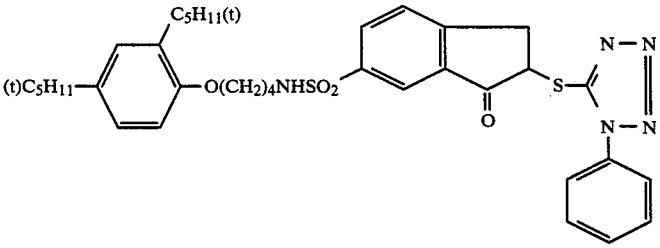
[D-118]
[D-119]

-continued

Compound No.

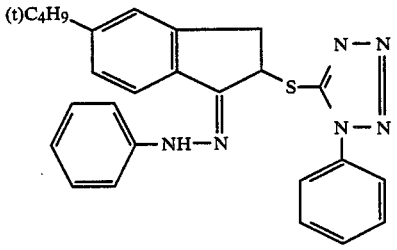

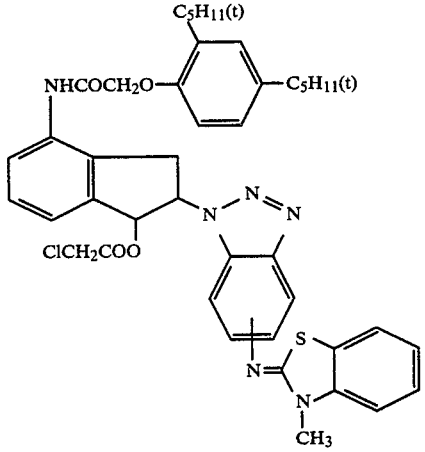

[D-120]

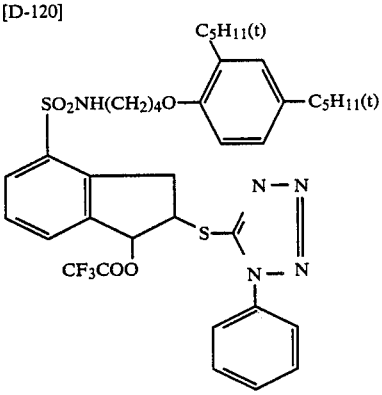

[D-121]

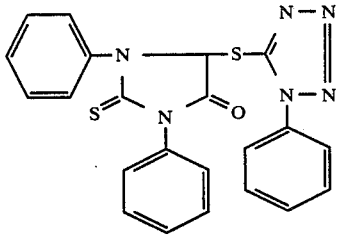

[D-122]

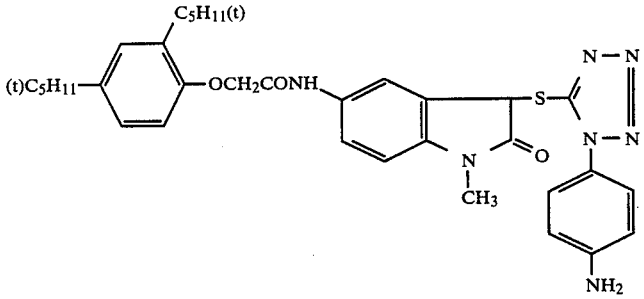

The other compositions of the silver halide light-sensitive color photographic material in accordance with the present invention may be determined as described in the above-mentioned literature 1 or "Research Disclosure" No. 18431.

The silver halide light-sensitive color photographic material in accordance with the present invention is highly sensitive and used for photographing purposes, for example, for color negative films, color reversal films, 8 mm color films, motion picture films and the like.

The light-sensitive color photographic material in accordance with the present invention can yield a color image by ordinary color development process following exposure. The basic processes in the negative-positive method include the color development, bleaching, and fixing processes. The basic processes of the reversal method include development with a black and white negative developing solution, followed by exposure to white light or treatment with a processing solution containing fogging agent, color development, bleaching and fixing. These basic processes are conducted independently or, two or more basic processes are conducted in one step using a processing solution having the respective functions. For example, a combined color processing method is conducted by using a processing solution containing a color developing agent, a ferric salt bleaching constituent and a thiosulfate fixing constituent, and a combined bleaching and fixing method is conducted by using a processing solution containing iron (III) complex of ethylenediaminetetraacetic acid as the bleaching constituent and a thiosulfate fixing constituent.

The light-sensitive color photographic material in accordance with the present invention may be processed by any processing method consisting for example of color development, combined bleaching and fixing, if necessary followed by washing and stabilization; color development, bleaching, fixing, if necessary followed by washing and stabilization; pre-hardening, neutralization, color development, combined stopping and fixing, washing, bleaching, fixing, washing, post-hardening, and washing; color development, washing, subsidiary color development, stopping, bleaching, fixing, washing, and stabilization; pre-hardening, neutralization, washing, first development, stopping, washing, color development, stopping, washing, bleaching, fixing, and washing; pre-hardening, neutralization, first development, stopping, washing, color development, stopping, washing, bleaching, organic acid bath, fixing, and washing; first development, non-fixing silver dye bleaching and washing, color development, acid rinsing, washing, bleaching, washing, fixing, washing, stabilization, and washing; halogenation belaching of developed silver generated by color development, followed by color development to increase the amount of dye formed; or processing of a low-silver light-sensitive material with an amplifier such as peroxide or cobalt complex.

Typical examples of the color developing agents used in the developing solution are aromatic primary amino compounds such as p-phenylenediamines and p-aminophenols. The typical examples of these compounds are:

N,N-Dimethyl-p-phenylenediamine, N,N-diethyl-p-phenylenediamine, 3-methyl-N,N-diethyl-p-phenylenediamine, N-carbamidemethyl-N-methyl-p-phenylenediamine, N-carbamidemethyl-N-tetrahydrofurfuryl-2-methyl-p-phenylenediamine, N-ethyl-N-carboxymethyl-2-methyl-p-phenylenediamine, N-carbamidemethyl-N-ethyl-2-methyl-p-phenylenediamine, 3-β-methanesulfonamidoethyl-4-amino-N,N-diethylaniline, N-ethyl-N-tetrahydrofurfuryl-2-methyl-p-aminophenol, 3-acetylamino-4-aminodimethylaniline, 3-methyl-4-amino-N-ethyl-N-β-hydroxyethylaniline, N-ethyl-N-β-methanesulfonamidoethyl-4-aminoaniline, 3-methyl-4-amino-N-ethyl-N-β-methanesulfonamidoethylaniline, N-ethyl-N-β-methanesulfonamidoethyl-3-methyl-4-aminoaniline, 3-methyl-4-amino-N-ethyl-N-β-methoxyethylaniline, N-methyl-N-β-sulfoethyl-p-phenylenediamine, N-ethyl-N-β-(β-methoxyethoxy)ethyl-3-methyl-4-aminoaniline, N-ethyl-N-β-[β-(β-methoxyethoxy)ethoxy]-ethyl-3-methyl-4-aminoaniline, o-aminophenol, p-aminophenol, 5-amino-2-oxy-toluene inorganic acid salt such as hydrochloric acid or sulfuric acid, or organic acid salt such as p-toluenesulfonate and the like.

Typical examples thereof are also described in Japanese Provisional Patent Publication Nos. 64932/1973, 131526/1975 and 95849/1976, and by Bent et al. in "Journal of the American Chemical Society", Vol. 73, pages 3100–3125, 1951.

The amount of the aromatic primary amino compound used is determined by the desired activity of the developing solution. To increase the activity, the amount used should be raised. It is generally used in an amount between 0.0002 mol/liter and 0.7 mol/liter. According to the purposes, it is possible to use a combination of two or more compounds, for example, 3-methyl-4-amino-N,N-diethylaniline and 3-methyl-4-amino-N-ethyl-N-β-methanesulfonamidoethylaniline; 3-methyl-4-amino-N-ethyl-N-β-methanesulfonamidoethylaniline and 3-methyl-4-amino-N-ethyl-N-β-hydroxyethylaniline; 3-methyl-4-amino-N-ethyl-N-β-methanesulfonamidoethylaniline and N-ethyl-N-β-[β-(β-methoxyethoxy)ethoxy]ethyl-3-methyl-4-aminoaniline; 3-methyl-4-amino-N,N-diethylaniline and 3-methyl-4-amino-N-ethyl-N-β-methanesulfonamidoethyl- and 3-methyl-4-amino-N-ethyl-N-β-hydroxyethylaniline and N-ethyl-N-β-[β-(β-methoxyethoxy)ethoxy]ethyl-3-methyl-4-aminoaniline; 3-methyl-4-amino-N-ethyl-N-β-methanesulfonamidoethylaniline and 3-methyl-4-amino-N-β-methoxyethylaniline.

The color developing solution may further contain various constituents ordinarily used in such solutions, for example, alkali agents such as sodium hydroxide, sodium carbonate and potassium carbonate, alkali metal sulfite, alkali metal bisulfite, alkali metal thiocyanate, alkali metal halide, benzyl alcohol, water softening agent, thickening agent and development accelerator. The pH value of the color developing solution is normally 7 or more, most generally between about 9 and about 13.

Additives used as required in the color developing solution include for example hydroxides, carbonates, and phosphates of alkali metals and ammonium for keeping the pH value constant; pH adjusting or buffering agents (e.g. weak acids such as acetic acid and boric acid, weak bases, and their salts); development accelerators such as pyridinium compounds, cationic compounds, potassium nitrate and sodium nitrate, polyethylene glycol condensates, phenyl cellosolve, phenylcarbitol, alkyl cellosolve, phenylcarbitol, dialkylformamide, alkyl phosphate and derivatives thereof, nonionic compounds such as polythioethers, polymers having sulfite esters, organic amines such as pyridine and ethanolamine, benzyl alcohol and hydrazine.

Examples of fog restrainers include bromides such as potassium bromide, sodium bromide and ammonium bromide, compounds used for quick processing solutions such as alkali iodide, nitrobenzoimidazole, mercaptobenzoimidazole, 5-methylbenzotriazole, and 1-phenyl-5-mercaptotetrazole, nitro benzoate, benzothiazolium derivatives and phenazine N-oxide.

It is also possible to use stain preventing agents, sludge preventing agents, interlayer effect accelerators, preservatives (e.g. sulfite, acid sulfite, hydroxylamine hydrochloride, formsulfite, alkanolamine sulfite adduct), and chelating agents.

Examples of the chelating agents are phosphates such as polyphosphates, aminopolycarboxylic acids such as nitrilotriacetic acid and 1-3-diamino-2-propanoltetraacetic acid, oxycarboxylic acids such as citric acid and gluconic acid, and 1-hydroxy-1,1'-diphosphonic acid. These chelating agents may be used in combination with each other or with lithium sulfate.

Metal complexes of organic acids used as the bleaching agent in the bleaching solution or in the combined bleaching and fixing solution oxidize the metallic silver formed by the development and convert it into silver halides, and at the same time cause the noncolor-forming portion of the color forming agent to develop color. The metal complexes of organic acids have a structure in which metal ions such as iron, cobalt and copper are coordinated with organic acids such as aminopolycarboxylic acid, oxalic acid or citric acid. The most preferable organic acids used for forming such metal complexes are aminopolycarboxylic acids represented by the general formulas (IV) and (V):

$$HOCO—A_1—Z—A_2—COOH \quad (IV)$$

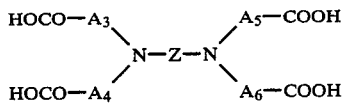

(V)

in which $A_1$, $A_2$, $A_3$, $A_4$, $A_5$ and $A_6$ each designate a substituted or unsubstituted hydrocarbon group, and Z designates a hydrocarbon group, oxygen atom, sulfur atom or $>N—A_7$ wherein $A_7$ denotes a hydrocarbon group or a lower aliphatic carboxilic acid.

These aminopolycarboxylic acids may be used in the form of an alkali metal salt, an ammonium salt or a water-soluble amine salt. The typical examples of the aminopolycarboxylic acids represented by the general formulas (IV) and (V) and the other aminopolycarboxylic acids are:

Ethylenediaminetetraacetic acid,
diethylenetriaminepentaacetic acid,
ethylenediamine-N-(β-oxyethyl)-N,N',N'-triacetic acid,
propylenediaminetetraacetic acid,
nitrilotriacetic acid,
cyclohexanediaminetetraacetic acid,
iminodiacetic acid,
dihydroxyethylglycine,
ethyletherdiaminetetraacetic acid,
glycoletherdiaminetetraacetic acid,
ethylenediaminetetrapropionic acid,
phenylenediaminetetraacetic acid,
disodium ethylenediaminetetraacetate,
tetra(trimethylammonium)ethylenediaminetetraacetate,
tetrasodium ethylenediaminetetraacetate,
pentasodium diethylenetriaminepentaacetate,
sodium ethylenediamine-N-(β-oxyethyl)-N,N',N'-triacetate,
sodium propylenediaminetetraacetate,
sodium nitrilotriacetate, and
sodium cyclohexanediaminetetraacetate.

In addition to the above-mentioned metal complexes of organic acids as the bleaching agents, various additives may be contained in the bleaching solution. The additives may preferably be re-halogenating agents such as alkali halides and ammonium halides e.g. potassium bromide, sodium bromide, sodium chloride and ammonium bromide. It is also possible to add pH buffering agents such as borate, oxalate, acetate, carbonate and phosphate, and other additives which is usually used in bleaching solutions such as polyaminocarboxylic acids and their salts, alkylamines and polyethylene oxides.

When a combined bleaching and fixing solution (bleach-fixing solution) is used in the bleaching process, a bleach-fixing solution containing the above-mentioned metal complexes of organic acids as the belaching agents and silver halide fixing agents such as thiosulfates, thiocyanates and thioureas is used. The solution may also contain a small or large amount of halogen compounds such as potassium bromide. It is also possible to use a special bleaching and fixing solution consisting of a combination of a bleaching agent and a large amount of halogen compounds such as potassium bromide. The above-mentioned halogen compounds may be potassium bromide, hydrochloric acid, hydrobromic acid, lithium bromide, sodium bromide, ammonium bromide, potassium iodide and ammonium iodide.

Typical examples of the silver halide fixing agents contained in the bleach-fixing solution are the compounds forming water-soluble complexes by the reaction with silver halides, which are used in usual fixing, e.g. thiosulfates such as potassium thiosulfate, sodium thiosulfate and ammonium thiosulfate, thiocyanates such as potassium thiocyanate, sodium thiocyanate, and ammonium thiocyanate, or thioureas and thioethers.

Like a bleaching solution, the bleach-fixing solution may further contain pH buffering agents such as boric acid, borax, sodium hydroxide, potassium hydroxide, sodium carbonate, potassium carbonate, sodium bicarbonate, potassium bicarbonate, acetic acid, sodium acetate and ammonium hydroxide alone or in combination. The solution may also contain various brightening agents, anti-foaming agents and surface active agents. It is also possible to add preservatives such as bisulfite addition compounds of hydroxylamine, hydrazine, and aldehyde compounds, organic chelating agents such as aminopolycarboxylic acids, stabilizers such as nitroalcohol nitrate, organic solvents such as methanol, dimethylsulfoamide, and dimethylsulfoxide.

The silver halide fixing agents are the compounds forming water-soluble complexes by the reaction with silver halides, which are used in usual fixing. The typical examples thereof are thiosulfates such as potassium thiosulfate, sodium thiosulfate, and ammonium thiosulfate, thiocyanates such as potassium thiocyanate, sodium thiocyanate, and ammonium thiocyanate, or thioureas and thioethers. These agents may be used alone or in combination. In the latter case, they may be combined in any proportion. The halides of alkali metals or ammonium sometimes exhibit the fixing action.

The fixing solution may be incorporated with various additives as required, e.g. pH buffering agents such as boric acid, borax, sodium hydroxide, potassium hydroxide, sodium carbonate, potassium carbonate, sodium bicarbonate, potassium bicarbonate, acetic acid, sodium acetate and ammonium hydroxide alone or in combination. The solution may also contain various brightening agents, anti-foaming agents and surface active agents. It is also possible to add preservatives such as sulfurous acid, bisulfite addition compounds of hydroxylamine, hydrazine, and aldehyde compounds, organic chelating agents such as aminopolycarboxylic acids, stabilizers such as nitroalcohol nitrate, organic solvents such as methanol, dimethylsulfoamide, and dimethylsulfoxide. Conventional fixing accelerators may be added optionally.

The present invention is hereinafter illustrated by the following nonlimitative examples.

First, the preparations of the emulsions used in the examples are described below.

(Preparation of polydispersed emulsion)

An aqueous silver nitrate solution and an aqueous alkali halide solution were naturally dropped into a reactor containing an aqueous gelatin solution and an excess of halide and maintained at 60° C. Then after an aqueous Demool-N (made by KAO Atlas Co., Ltd.) solution and aqueous magnesium sulfate solution were added to cause precipitation, desalting was done, and gelatin was added to obtain an emulsion having a pAg value of 7.8 and a pH value of 6.0. Further, sodium thiosulfate, chloroauric acid and ammonium rhodanate were added, and the resulting mixture was subjected to chemical ripening. Thereafter, 4-hydroxy-6-methyl-1,3,3a,7-tetrazaindene and 6-nitrobenzimidazole were added, and gelatin was added to obtain a polydispersed silver iodobromide emulsion. The molar percentage of the silver iodide was changed by changing the composition of the alkali halide, and the average crystal size and crystal size distribution were changed by changing the time for adding the aqueous silver nitrate solution and the aqueous alkali halde solution.

(Preparation of monodispersed emulsion)

An aqueous ammoniacal silver nitrate solution and an aqueous potassium bromide solution were added to a reactor previously containing seed grains of silver halide and an aqueous gelatin solution while the pAg and pH in the reactor were controlled adequately. This addition was done in proportion to the increase in the surface area of crystals during the growth thereof. Then, after an aqueous Demool-N (made by KAO Atlas Co., Ltd.) solution and aqueous magnesium sulfate solution were added to cause precipitation, desalting was done, and gelatin was added to obtain an emulsion having a pAg value of 7.8 and a pH value of 6.0. Further, sodium thiosulfate, chloroauric acid and ammonium rhodanate were added, and the resulting mixture was subjected to chemical ripening. Thereafter, 4-hydroxy-6-methyl-1,3,3a,7-tetrazaindene and 6-nitrobenzimidazole were added, and gelatin was further added to obtain a monodispersed silver iodobromide emulsion. The molar percentage of the silver iodide was changed by changing the ratio of potassium iodide to potassium bromide. The crystal size was changed by changing the amounts of the ammoniacal silver nitrate and the potassium halide added. Furthermore crystal shape was changed by varying the pAg value during a precipitation procedure.

EXAMPLE 1

Specimen No. 1 was prepared by sequentially applying the layers described below on a transparent support made of an under-coated cellulose triacetate film. (In all examples below, addition amount to the silver halide light-sensitive color photographic material is the amount per 1 $m^2$, and the amounts of the silver halide emulsion and the colloidal silver are expressed in terms of silver.)

(Specimen No. 1)

Layer 1: Antihalation layer containing 0.4 g of black colloidal silver and 3 g of gelatin.

Layer 2: Low-sensitivity red-sensitive emulsion layer containing 0.9 g of silver iodobromide low-sensitivity red-sensitive emulsion (obtained by red-sensitization of emulsion 4 in Table 1), 0.9 g of silver iodobromide low-sensitivity red-sensitive emulsion (obtained by red-sensitization of emulsion 8 in Table 1), 2.2 g of gelatin and 0.8 g of tricresyl phosphate (hereinafter referred to as TCP) in which 1.0 g of 1-hydroxy-2-[δ-(2,4-di-tert-amylphenoxy)-n-butyl]-naphthoamide [hereinafter referred to as cyan coupler(C-1)], 0.075 g of 1-hydroxy-4-[4-(1-hydroxy-8-acetamido-3,6-disulfo-2-naphthylazo)phenoxy]-N-[δ-(2,4-di-tert-amylphenoxy)butyl]-2-naphthoamide disodium salt [hereinafter referred to as colored cyan coupler(CC-1)] and 0.012 g of 4-octadecylsuccinimido-2-(1-phenyl-5-tetrazolylthio)-1-indanone [hereinafter referred to as DIR compound(D-1)] were dissolved.

Layer 3: High-sensitivity red-sensitive emulsion layer containing 1.8 g of a silver iodobromide high-sensitivity red-sensitive emulsion (obtained by red-sensitization of emulsion 1 in Table 1), 1.2 g of gelatin and 0.30 g of TCP in which 0.26 g of the cyan coupler(C-1) and 0.03 g of the colored cyan coupler(CC-1) were dissolved.

Layer 4: Intermediate layer containing 0.04 g of di-n-butyl phthalate (hereinafter referred to as DBP) in which 0.07 g of 2,5-di-tert-octylhydroquinone [hereinafter referred to as stain preventing agent(HQ-1)] was dissolved, and 0.8 g of gelatin.

Layer 5: Low-sensitivity green-sensitive emulsion layer containing 0.8 g of a silver iodobromide low-sensitivity green-sensitive emulsion (obtained by green-sensitization of emulsion 4 in Table 1), 0.8 g of a silver iodobromide low-sensitivity green-sensitive emulsion (obtained by green-sensitization of emulsion 8 in Table 1), 2.2 g of gelatin and 0.95 g of TCP in which 0.8 g of 1-(2,4,6-trichlorophenyl)-3-[3-(2,4-di-tert-amylphenoxyacetamido)benzamido]-5-pyrazolone [hereinafter referred to as magenta coupler(M-1)], 0.016 g of DIP compound (D-1) and 0.15 g of 1-(2,4,6-trichlorophenyl)-4-(1-naphthylazo)-3-(2-chloro-5-octadecenylsuccinimidoanilino)-5-pyrazolone [hereinafter referred to as colored magenta coupler (CM-1)] were dissolved.

Layer 6: High-sensitivity green-sensitive emulsion layer containing 1.8 g of a silver iodobromide high-sensitivity green-sensitive emulsion (obtained by green-sensitization of emulsion 1 in Table 1), 1.9 g of gelatin and 0.25 g of TCP in which 0.20 g of the magenta coupler (M-1) and 0.049 g of the colored magenta coupler (CM-1) were dissolved.

Layer 7: Yellow filter layer containing 0.15 g of yellow colloidal silver, 0.11 g of DBP in which 0.2 g of stain preventing agent(HQ-1) was dissolved, and 1.5 g of gelatin.

Layer 8: Low-sensitivity blue-sensitive emulsion layer containing 0.50 g of a silver iodobromide low-sensitivity blue-sensitive emulsion (emulsion 4 in Table 1), 1.9 g of gelatin and 0.6 g of DBP in which 1.5 g of α-pivaloyl-α-(1-benzyl-2-phenyl-3,5-dioxoimidazolidin-4-yl)-2'-chloro-5'-[α-(dodecyloxycarbonyl)ethoxycarbonyl]acetanilide [hereinafter referred to as yellow coupler (Y-1)] was dissolved.

Layer 9: High-sensitivity blue-sensitive emulsion layer containing 1.0 g of a silver iodobromide high-sensitivity blue-sensitive emulsion (emulsion 1 in Table 1), 1.5 g of gelatin and 0.65 g of TCP in which 1.30 g of the yellow coupler(Y-1) was dissolved.

Layer 10: Protective layer containing 2.3 g of gelatin.

The emulsions employed in respective light-sensitive layers were obtained by individually suitably sensitizing the silver iodobromide emulsions having the physical properties listed in Table 1.

By varying the kinds of the emulsions contained in respective light-sensitive emulsion layers (Layer 2, 3, 5, 6, 8 and 9) in the above specimen (1) and at the same time selecting suitably the amounts of the DIR compound (D-1) so that each specimen may have equal γ values, there were prepared 8 kinds as a total of light-sensitive materials of specimens (2) to (8) according to the same method as in the above specimen (1). The $\gamma$ values were determined here by the gradients of the straight lines passing the point of the fog+0.3 and the point of the fog+1.8.

TABLE 1

| Emulsion | Silver iodide [mole %] | Average Crystal size [μ] | S/r̄ | Shape of crystal |
|---|---|---|---|---|
| 1 | 7 | 0.91 | 0.25 | Twin & Cube |
| 2 | 7 | 0.90 | 0.08 | Cube |
| 3 | 2 | 0.92 | 0.09 | " |
| 4 | 6 | 0.60 | 0.23 | Twin & Cube |
| 5 | 6 | 0.61 | 0.09 | Cube |
| 6 | 5 | 0.61 | 0.09 | " |
| 7 | 2 | 0.62 | 0.08 | " |
| 8 | 6 | 0.29 | 0.28 | Twin & Cube |
| 9 | 6 | 0.30 | 0.07 | Cube |
| 10 | 5 | 0.31 | 0.08 | " |
| 11 | 2 | 0.30 | 0.08 | " |
| 12 | 7 | 0.91 | 0.09 | Tetradeca-hedron |
| 13 | 6 | 0.60 | 0.09 | Tetradeca-hedron |
| 14 | 6 | 0.31 | 0.08 | Tetradeca-hedron |
| 15 | 5 | 0.31 | 0.09 | Tetradeca-hedron |

TABLE 2

| | Specimen 1 (Comparative) | Specimen 2 (Comparative) | Specimen 3 (This Invention) | Specimen 4 (This Invention) | Specimen 5 (This Invention) | Specimen 6 (This Invention) | Specimen 7 (This Invention) | Specimen 8 (This Invention) |
|---|---|---|---|---|---|---|---|---|
| Layer 2 | Emulsion 4<br>Emulsion 8 | Emulsion 4<br>Emulsion 8 | Emulsion 4<br>Emulsion 8 | Emulsion 4<br>Emulsion 8 | Emulsion 4<br>Emulsion 8 | Emulsion 4<br>Emulsion 8 | Emulsion 5<br>Emulsion 9 | Emulsion 5<br>Emulsion 9 |
| Layer 3 | Emulsion 1 | Emulsion 1 | Emulsion 1 | Emulsion 1 | Emulsion 1 | Emulsion 1 | Emulsion 2 | Emulsion 2 |
| Layer 5 | Emulsion 4<br>Emulsion 8 | Emulsion 5<br>Emulsion 9 | Emulsion 7<br>Emulsion 11 | Emulsion 6<br>Emulsion 10 | Emulsion 13<br>Emulsion 14 | Emulsion 5<br>Emulsion 9 | Emulsion 5<br>Emulsion 9 | Emulsion 5<br>Emulsion 9 |
| Layer 6 | Emulsion 1 | Emulsion 3 | Emulsion 2 | Emulsion 2 | Emulsion 12 | Emulsion 2 | Emulsion 2 | Emulsion 2 |
| Layer 8 | Emulsion 4 | Emulsion 4 | Emulsion 4 | Emulsion 4 | Emulsion 4 | Emulsion 4 | Emulsion 4 | Emulsion 5 |
| Layer 9 | Emulsion 1 | Emulsion 1 | Emulsion 1 | Emulsion 1 | Emulsion 1 | Emulsion 1 | Emulsion 1 | Emulsion 2 |
| Sensitivity difference between Layer 5 and Layer 6 | 0.37 | 0.36 | 0.35 | 0.37 | 0.36 | 0.36 | 0.37 | 0.36 |

The obtained eight specimens were respectively subjected to exposure to white light through an optical wedge and then respectively processed by the processes described below to yield the specimens having dye images.

| Processes (processing temperature: 38° C.) | Processing time |
|---|---|
| Color development | 3 minutes 15 seconds |
| Bleaching | 6 minutes 30 seconds |
| Washing with water | 3 minutes 15 seconds |
| Fixing | 6 minutes 30 seconds |
| Washing with water | 3 minutes 15 seconds |
| Stabilization | 1 minute 30 seconds |
| Drying | |

The following processing solutions were used in each processing steps:

| | |
|---|---|
| [Color developing solution] | |
| 4-Amino-3-methyl-N—ethyl-N—(β-hydroxyethyl)-aniline sulfate | 4.75 g |
| Anhydrous sodium sulfite | 4.25 g |
| Hydroxylamine half-sulfate | 2.0 g |

-continued

| | |
|---|---|
| Anhydrous potassium carbonate | 37.5 g |
| Sodium bromide | 1.3 g |
| Trisodium salt of nitrilotriacetate (monohydrate) | 2.5 g |
| Potassium hydroxide | 1.0 g |
| Make up to 1 liter with water | |
| [Bleaching solution] | |
| Ferric ammonium salt of ethylenediamine-tetraacetic acid | 100.0 g |
| Diammonium salt of ethylenediamine-tetraacetic acid | 10.0 g |
| Ammonium bromide | 150.0 g |
| Glacial acetic acid | 10.0 ml |
| Make up to 1 liter with water and adjust to pH 6.0 with aqueous ammonia. | |
| (Fixing solution) | |
| Ammonium thiosulfate | 175.0 g |
| Anhydrous sodium sulfite | 8.6 g |
| Sodium metasulfite | 2.3 g |
| Make up to 1 liter with water and adjust to pH 6.0 with acetic acid. | |
| (Stabilizing solution) | |
| Formalin (37% aqueous solution) | 1.5 ml |
| Konidax (available from Konishiroku Photo Industry Co., Ltd.) | 7.5 ml |
| Make up to 1 liter with water. | |

For each of the obtained specimens, relative sensitivity and latitude of exposure were measured using blue light (B), green light (G) and red light (R), respectively. The results are shown in Table 3.

Relative sensitivity was shown in terms of the relative value of reciprocal number of the dose of exposure giving the fog density+0.1, and latitude of exposure as a measure indicating its breadth adopted the linear exposure scale (hereinafter called as L.E.S.) as described in "The Theory of the Photographic Process" 4th Edition, page 501–502, written by T. H. James.

TABLE 3

| Specimen | | Blue light measurement | Green light measurement | Red light measurement |
|---|---|---|---|---|
| 1 (Comparative) | Relative sensitivity | 100 | 100 | 100 |
| | L.E.S. | 2.58 | 2.65 | 2.66 |
| 2 (Comparative) | Relative sensitivity | 99 | 109 | 98 |
| | L.E.S. | 2.57 | 2.70 | 2.67 |
| 3 (This Invention) | Relative sensitivity | 100 | 115 | 101 |
| | L.E.S. | 2.59 | 2.86 | 2.65 |
| 4 (This Invention) | Relative sensitivity | 98 | 113 | 101 |
| | L.E.S. | 2.59 | 2.90 | 2.67 |

TABLE 3-continued

| Specimen | | Blue light measurement | Green light measurement | Red light measurement |
|---|---|---|---|---|
| 5 (This Invention) | Relative sensitivity | 102 | 113 | 101 |
| | L.E.S. | 2.60 | 2.92 | 2.70 |
| 6 (This Invention) | Relative sensitivity | 98 | 114 | 100 |
| | L.E.S. | 2.60 | 2.91 | 2.69 |
| 7 (This Invention) | Relative sensitivity | 102 | 112 | 116 |
| | L.E.S. | 2.61 | 2.99 | 2.91 |
| 8 (This Invention) | Relative sensitivity | 112 | 113 | 115 |
| | L.E.S. | 2.91 | 3.03 | 2.99 |

As apparently seen from Table 3, as compared with specimens 3 to 8 according to this invention, the comparative specimen 1 in which a polydispersed silver halide emulsion was employed was confirmed to have a small L.E.S. value under green light. Even the comparative specimen 2 in which a monodispersed silver halide emulsion was employed, because the silver iodide content in the silver halide crystals contained therein does not belong to the range of this invention, was also confirmed to have a small L.E.S. value under green light as compared with specimens of this invention. Further, among the specimens according to this invention, the specimen (8) in which all the layers satisfied the requirements of this invention was confirmed to exhibit most markedly the effect of this invention.

EXAMPLE 2

Specimen (9) was prepared by sequentially applying the layers described below on a transparent support made of an under-coated cellulose triacetate film.

[Specimen (9)]

Layer 1: Layer 1 as described in Example 1

Layer 2: A low-sensitivity red-sensitive emulsion layer containing 1.4 g of a silver iodobromide low-sensitivity red-sensitive emulsion (obtained by red-sensitization of emulsion 8 in Table 1), 1.2 g of gelatin and 0.65 g of TCP in which 0.8 g of the cyan coupler (C-1), 0.065 g of the colored cyan coupler (CC-1) and 0.015 g of the DIR compound (D-1) were dissolved.

Layer 3: A medium-sensitivity red-sensitive emulsion layer containing 0.9 g of an iodobromide medium-sensitivity red-sensitive emulsion (obtained by red-sensitization of emulsion 4 in Table 1), 0,9 g of gelatin and 0.25 g of TCP in which 0.24 g of the cyan coupler (C-1) and 0.015 g of the colored cyan coupler (CC-1) were dissolved.

Layer 4: A high-sensitivity red-sensitive emulsion layer containing 1.3 g of an iodobromide high-sensitivity red-sensitive emulsion (obtained by red-sensitization of emulsion 1 in Table 1), 1.2 g of gelatin and 0.23 g of TCP in which 0.21 g of the cyan coupler (C-1) and 0.02 g of the colored cyan coupler (CC-1) were dissolved.

Layer 5: The Layer 4 as described in Example 1.

Layer 6: The Layer 5 as described in Example 1.

Layer 7: The Layer 6 as described in Example 1.

Layer 8: The Layer 7 as described in Example 1.

Layer 9: The Layer 8 as described in Example 1.

Layer 10: The Layer 9 as described in Example 1.

Layer 11: The Layer 10 as described in Example 1.

Seven kinds as a total of light-sensitive color photographic materials of the specimens (10) to (15) according to the same method as in the above specimen (9) by varying the kinds of emulsions contained in the respective emulsion layers (Layer 2, 3, 4, 6, 7, 9 and 10) as shown in Table 4 and at the same time selecting the amounts of the DIR compound (D-1) so that the respective specimens may have equal $\gamma$ values.

TABLE 4

| | Specimen 9 (Comparative) | Specimen 10 (Comparative) | Specimen 11 (Comparative) | Specimen 12 (This Invention) | Specimen 13 (This Invention) | Specimen 14 (This Invention) | Specimen 15 (This Invention) |
|---|---|---|---|---|---|---|---|
| Layer 2 | Emulsion 8 | Emulsion 9 | Emulsion 9 | Emulsion 11 | Emulsion 10 | Emulsion 15 | Emulsion 15 |
| Layer 3 | Emulsion 4 | Emulsion 5 | Emulsion 7 | Emulsion 5 | Emulsion 5 | Emulsion 13 | Emulsion 13 |
| Layer 4 | Emulsion 1 | Emulsion 3 | Emulsion 2 | Emulsion 2 | Emulsion 2 | Emulsion 12 | Emulsion 12 |
| Layer 6 | Emulsion 4 | Emulsion 4 | Emulsion 4 | Emulsion 4 | Emulsion 4 | Emulsion 4 | Emulsion 15 |
| | Emulsion 8 | Emulsion 8 | Emulsion 8 | Emulsion 8 | Emulsion 8 | Emulsion 8 | Emulsion 13 |
| Layer 7 | Emulsion 1 | Emulsion 1 | Emulsion 1 | Emulsion 1 | Emulsion 1 | Emulsion 1 | Emulsion 12 |
| Layer 9 | Emulsion 4 | Emulsion 4 | Emulsion 4 | Emulsion 4 | Emulsion 4 | Emulsion 4 | Emulsion 13 |
| Layer 10 | Emulsion 1 | Emulsion 1 | Emulsion 1 | Emulsion 1 | Emulsion 1 | Emulsion 1 | Emulsion 12 |
| Sensitivity difference between Layer 3 and Layer 4 (Δ log E) | 0.37 | 0.35 | 0.37 | 0.35 | 0.39 | 0.38 | 0.38 |
| Sensitivity difference between Layer 2 and Layer 3 (Δ log E) | 0.50 | 0.52 | 0.51 | 0.49 | 0.49 | 0.50 | 0.50 |

For the seven kinds of the obtained specimens, specimens having dye images were prepared according to the same method as in Example 1, respectively.

For each of the obtained specimens, relative sensitivity and latitude of expoosure were measured similarly as in Example 1 to obtain the results as shown in Table 5.

TABLE 5

| Specimen | | Blue light measurement | Green light measurement | Red light measurement |
|---|---|---|---|---|
| 9 (Comparative) | Relative sensitivity | 100 | 100 | 100 |
| | L.E.S. | 2.59 | 2.66 | 2.68 |

TABLE 5-continued

| Specimen | | Blue light measurement | Green light measurement | Red light measurement |
|---|---|---|---|---|
| 10 (Comparative) | Relative sensitivity | 97 | 101 | 109 |
| | L.E.S. | 2.58 | 2.67 | 2.72 |
| 11 (Comparative) | Relative sensitivity | 100 | 100 | 115 |
| | L.E.S. | 2.57 | 2.65 | 2.73 |
| 12 (This Invention) | Relative sensitivity | 101 | 100 | 115 |
| | L.E.S. | 2.57 | 2.65 | 2.88 |
| 13 (This Invention) | Relative sensitivity | 100 | 99 | 116 |
| | L.E.S. | 2.58 | 2.68 | 2.95 |
| 14 (This Invention) | Relative sensitivity | 100 | 101 | 115 |
| | L.E.S. | 2.60 | 2.68 | 2.96 |
| 15 (This Invention) | Relative sensitivity | 112 | 115 | 116 |
| | L.E.S. | 2.92 | 3.01 | 3.01 |

As apparently seen from Table 5, as compared with the specimens 12 to 15 according to this invention, the comparative specimen 9 in which a polydispersed silver halide emulsion was employed was confirmed to have a small L.E.S. value under red light. Also, the comparative specimens 10 and 11 in which monodispersed silver halide emulsions were employed, although they are improved over the comparative specimen 9 in which a polydispersed silver halide emulsion was employed, were confirmed to have smaller values as compared with the specimens of this invention. That is, the specimens of this invention were confirmed to be excellent with respect to enlargement of exposure region.

EXAMPLE 3

Development processings were applied on 8 kinds of the specimens as described in Example 1 by varying the processing times 2 minutes 55 seconds, 3 minutes 15 seconds and 3 minutes 35 seconds, respectively. For each of the obtained specimens, relative sensitivity and latitude of exposure were measured by use of blue light (B), green light (G) and red light (R), and the respective changes of sensitivity and $\gamma$ shown by the gradient of gradation were determined.

Sensitivity was determined as the reciprocal number of dose of exposure necessary to obtain a density with fog+0.1 similarly as in Example 1, and $\gamma$ value also similarly as the gradient of the straight line passing the point of fog+0.3 and point of fog+1.8.

For convenience of making comparison between these results easier, the sensitivity and $\gamma$ value at the time of development for 3 minutes 15 seconds were made as 100% for each specimen, and the changes at the time of development for 2 minutes 55 second and 3 minutes 35 seconds were determined in %, and the results thereof are shown in Table 6.

TABLE 6

| Specimen | Time | Change of sensitivity | | | Change of $\gamma$ | | |
|---|---|---|---|---|---|---|---|
| | | B | G | R | B | G | R |
| 1 (Comparative) | 2'55" | 75 | 74 | 70 | 89 | 93 | 90 |
| | 3'35" | 129 | 129 | 133 | 115 | 107 | 114 |
| 2 (Comparative) | 2'55" | 77 | 76 | 69 | 89 | 94 | 90 |
| | 3'35" | 130 | 127 | 132 | 114 | 106 | 113 |
| 3 (This Invention) | 2'55" | 77 | 84 | 69 | 89 | 96 | 90 |
| | 3'35" | 130 | 117 | 133 | 115 | 105 | 113 |

TABLE 6-continued

| Specimen | Time | Change of sensitivity | | | Change of $\gamma$ | | |
|---|---|---|---|---|---|---|---|
| | | B | G | R | B | G | R |
| 4 (This Invention) | 2'55" | 76 | 85 | 70 | 89 | 96 | 90 |
| | 3'35" | 131 | 116 | 132 | 115 | 103 | 113 |
| 5 (This Invention) | 2'55" | 76 | 86 | 71 | 89 | 96 | 90 |
| | 3'35" | 130 | 116 | 130 | 115 | 103 | 114 |
| 6 (This Invention) | 2'55" | 76 | 86 | 69 | 90 | 97 | 90 |
| | 3'35" | 131 | 117 | 131 | 115 | 103 | 113 |
| 7 (This Invention) | 2'55" | 77 | 86 | 84 | 89 | 98 | 96 |
| | 3'35" | 131 | 117 | 118 | 114 | 102 | 107 |
| 8 (This Invention) | 2'55" | 88 | 88 | 86 | 93 | 98 | 97 |
| | 3'35" | 115 | 116 | 118 | 105 | 102 | 106 |

Table 6 clearly shows that, as contrasted to comparative specimens in which sensitivity and $\gamma$ value are greatly changed by changing the processing time of color development, the specimens of this invention are changed with small widths of variances, thus indicating that they have excellent stability with respect to the development processing time.

We claim:

1. A light-sensitive silver halide color photographic material comprising a support and at least two silver halide emulsion layers on the same side of said support, said at least two silver halide emulsion layers being sensitive to different spectral regions, at least one layer of said silver halide emulsion layers comprising at least two silver halide emulsion layers having different light-sensitivity, each of said at least two emulsion layers having different light-sensitivity, containing at least one kind of substantially monodispersed silver halide crystals and at least one silver halide emulsion layer of said at least two emulsion layers having different light-sensitivity comprising a substantial amount of silver iodobromide containing at least 4 mole % of silver iodide, wherein the amount of iodine in the emulsion layer having the highest light-sensitivity is greater than the amount of iodine present in the emulsion layer having the second highest light-sensitivity.

2. The light-sensitive silver halide color photographic material according to claim 1, wherein the emulsion layer having the lowest light-sensitivity of the said at least two silver halide emulsion layers with different light-sensitivity contains at least two kinds of substantially monodispersed silver halide crystals having different average crystal sizes.

3. The light-sensitive silver halide color photographic material according to claim 1, wherein the difference in the amount of iodine in the emulsion layer having the highest light-sensitivity from the amount of iodine in the emulsion layer having the second highest light-sensitivity is within the range of 0.1 to 10 mole %.

4. The light-sensitive silver halide color photographic material according to claims 1 or 3, wherein the amount of iodine in the emulsion layer having the lowest light-sensitivity is at least 5 mole %.

5. The light-sensitive silver halide color photographic material according to claims 1 to 3, wherein said spectral regions are at least two regions selected from the group consisting of a red color region, a green color region and a blue color region.

6. The light-sensitive silver halide color photographic material according to claims 1 to 3, wherein the silver halide emulsion layer having the said silver halide emulsion layers with different light-sensitivity is at least one layer selected from the group consisting of red-sensitive silver halide emulsion layers, green-sensitive silver halide emulsion layers and blue-sensitive silver halide emulsion layers.

7. The light-sensitive silver halide color photographic material according to claim 6, wherein the silver halide emulsion layer having the said silver halide emulsion layers with different light-sensitivity is a green-sensitive silver halide emulsion layer.

8. The light-sensitive silver halide color photographic material according to claim 6, wherein the silver halide emulsion layers having the said silver halide emulsion layers with different light-sensitivity are a green-sensitive silver halide emulsion layer and a red-sensitive silver halide emulsion layer.

9. The light-sensitive silver halide color photographic material according to claim 6, wherein the silver halide emulsion layers having the said silver halide emulsion layers with different light-sensitivity are a green-sensitive silver halide emulsion layer a red-sensitive silver halide emulsion layer and a blue-sensitive silver halide emulsion layer.

10. The light-sensitive silver halide color photographic material according to claim 2, wherein the difference in the amount of iodine in the silver halide in the emulsion layer having the highest light-sensitivity from the amount of iodine in the emulsion layer having the second highest light-sensitivity is within the range from 0.1 to 10 mole %.

11. The light-sensitive silver halide color photographic material according to claim 10, wherein the amount of iodine in the emulsion layer having the lowest light-sensitivity is at least 5 mole %.

12. The light-sensitive silver halide color photographic material according to claim 4, wherein said spectral regions are at least two kinds of regions selected from the group consisting of a red color region, a green color region and a blue color region.

13. The light-sensitive silver halide color photographic material according to claim 10, wherein said spectral region are at least two kinds of regions selected from the group consisting of a red color region, a green color region and a blue color region.

14. The light-sensitive silver halide color photographic material according to claim 4, wherein the silver halide emulsion having the said silver halide emulsion layer with different light-sensitivity is at least one layer selected from the group consisting of red-sensitive silver halide emulsion layers, green-sensitive silver halide emulsion layers and blue-sensitive silver halide emulsion layers.

15. The light-sensitive silver halide color photographic material according to claim 10, wherein the silver halide emulsion layer having the said silver halide emulsion layer with different light-sensitivity is at least one layer selected from the group consisting of red-sensitive silver halide emulsion layers, green-sensitive silver halide emulsion layers and blue-sensitive silver halide emulsion layers.

16. The light-sensitive silver halide color photographic material according to claim 14, wherein the silver halide emulsion layer having the said silver halide emulsion layers with different light-sensitivity is a green-sensitive silver halide emulsion layer.

17. The light-sensitive silver halide color photographic material according to claim 15, wherein the silver halide emulsion layer having the said silver halide emulsion layers with different light-sensitivity is a green-sensitive silver halide emulsion layer.

18. The light-sensitive silver halide color photographic material according to claim 14, wherein the silver halide emulsion layers having the said silver halide emulsion layers with different light-sensitivity are a green-sensitive silver halide emulsion layer and a red-sensitive silver halide emulsion layer.

19. The light-sensitive silver halide color photographic material according to claim 15, wherein the silver halide emulsion layers having the said silver halide emulsion layers with different light-sensitivity are a green-sensitive silver halide emulsion layer and a red-sensitive silver halide emulsion layer.

20. The light-sensitive silver halide color photographic material according to claim 14, wherein the silver halide emulsion layers having the said silver halide emulsion layers with different light-sensitivity are a green-sensitive silver halide emulsion layer, a red-sensitive silver halide emulsion layer and a blue-sensitive silver halide emulsion layer.

21. The light-sensitive silver halide color photographic material according to claim 15, wherein the silver halide emulsion layers having the said silver halide emulsion layers with different light-sensitivity are a green-sensitive silver halide emulsion layer, a red-sensitive silver halide emulsion layer and a blue-sensitive silver halide emulsion layer.

* * * * *